US012078378B1

(12) United States Patent
Williams

(10) Patent No.: US 12,078,378 B1
(45) Date of Patent: Sep. 3, 2024

(54) CONTINUOUSLY VARIABLE CHILLER AND CONTROL SYSTEMS, METHODS, AND APPARATUSES

(71) Applicant: John R. Williams, Virginia Beach, VA (US)

(72) Inventor: John R. Williams, Virginia Beach, VA (US)

( * ) Notice: Subject to any disclaimer, the term of this patent is extended or adjusted under 35 U.S.C. 154(b) by 0 days.

(21) Appl. No.: 15/696,028

(22) Filed: Sep. 5, 2017

Related U.S. Application Data

(60) Provisional application No. 62/383,377, filed on Sep. 2, 2016.

(51) Int. Cl.
*F24F 11/83* (2018.01)
*F24F 1/0007* (2019.01)
(Continued)

(52) U.S. Cl.
CPC ..... *F24F 11/83* (2018.01); *F24F 1/0007* (2013.01); *F24F 5/0003* (2013.01); *F24F 5/0042* (2013.01); *F24F 5/0046* (2013.01); *F24F 11/30* (2018.01); *F24F 11/70* (2018.01); *F24F 11/77* (2018.01); *F24F 1/00077* (2019.02); *F24F 5/0089* (2013.01); *F24F 11/52* (2018.01); *F24F 11/84* (2018.01); *F24F 11/85* (2018.01); *F24F 2110/10* (2018.01); *F24F 2110/20* (2018.01); *F24F 2120/10* (2018.01); *F24F 2130/00* (2018.01); *F24F 2130/10* (2018.01); *F24F 2140/20* (2018.01); *F24F 2140/40* (2018.01);
(Continued)

(58) Field of Classification Search
CPC .. F24F 11/83; F24F 11/77; F24F 11/30; F24F 11/70; F24F 11/52; F24F 2110/20; F24F 2120/10; F25B 30/00; F25B 30/02
USPC ..... 165/240
See application file for complete search history.

(56) References Cited

U.S. PATENT DOCUMENTS 2,323,408 A 7/1943 Miller
4,179,894 A * 12/1979 Hughes ..... F24D 11/0221 62/79
(Continued)

FOREIGN PATENT DOCUMENTS

CN 2706704 6/2005
CN 1654893 8/2005
(Continued)

*Primary Examiner* — Joel M Attey
(74) *Attorney, Agent, or Firm* — Shaddock Law Group, PC

(57) ABSTRACT

A variable capacity chiller or hydronic heat pump with a compressor, a pump, and a condenser fan where system capacity is controlled by the speed of the compressor, pump, and/or condenser fan based on the flow rate and ΔT between the returning water temperature and leaving water temperature, where the compressor, pump, and fan adjust automatically to match the changing load conditions to match the capacity to the load, and which includes a psychrometric climate controller that manages a chiller or chiller heat pump to heat or cool a heat transfer fluid in communication with indoor heat exchanger(s) and where the setting for the entering or leaving heat transfer fluid temperature can be automatically varied based on psychrometric data or on information derived from such sensors, and when in heating mode, to dynamically manage an external backup resistance heat source to accurately match any shortfall of heating capacity.

4 Claims, 20 Drawing Sheets

(51) Int. Cl.

| | |
|---|---|
| ***F24F 5/00*** | (2006.01) |
| ***F24F 11/30*** | (2018.01) |
| ***F24F 11/70*** | (2018.01) |
| ***F24F 11/77*** | (2018.01) |
| *F24F 11/52* | (2018.01) |
| *F24F 11/84* | (2018.01) |
| *F24F 11/85* | (2018.01) |
| *F24F 110/10* | (2018.01) |
| *F24F 110/20* | (2018.01) |
| *F24F 120/10* | (2018.01) |
| *F24F 130/00* | (2018.01) |
| *F24F 130/10* | (2018.01) |
| *F24F 140/20* | (2018.01) |
| *F24F 140/40* | (2018.01) |
| *F24F 140/60* | (2018.01) |

(52) U.S. Cl.
CPC ..... *F24F 2140/60* (2018.01); *F24F 2203/021* (2013.01); *F24F 2221/34* (2013.01)

(56) References Cited

U.S. PATENT DOCUMENTS 4,512,161 A 4/1985 Logan
4,608,833 A 9/1986 Kountz
4,660,386 A 4/1987 Hansen et al.
4,856,286 A 8/1989 Sulfstede
4,942,740 A 7/1990 Shaw
5,058,389 A 10/1991 Yasuda
5,255,529 A 10/1993 Powell
5,271,238 A 12/1993 Powell
5,346,129 A 9/1994 Shah
5,396,779 A 3/1995 Voss
5,553,997 A 9/1996 Goshaw et al.
5,675,979 A 10/1997 Shah
5,737,934 A 4/1998 Shah
5,850,968 A * 12/1998 Jokinen ..... F24F 11/0008 165/223
5,963,458 A 10/1999 Cascia
6,070,110 A 5/2000 Shah
6,085,532 A 7/2000 Sibik
6,269,650 B1 8/2001 Shaw
6,276,152 B1 * 8/2001 Sibik ..... G05D 23/1919 62/203
6,352,106 B1 3/2002 Hartman
6,415,619 B1 7/2002 Bash
6,516,622 B1 2/2003 Wilson
6,532,754 B2 3/2003 Haley
6,826,922 B2 12/2004 Patel
6,854,287 B2 2/2005 Patel
6,996,999 B2 2/2006 Wacker
7,036,559 B2 5/2006 Stanimirovic
RE39,597 E 5/2007 Rousseau
7,559,207 B2 7/2009 Knight
7,726,151 B2 6/2010 Manole
7,836,712 B2 11/2010 Sasao
7,874,499 B2 1/2011 Lochtefeld
7,890,215 B2 2/2011 Duncan
7,975,495 B2 7/2011 Voorhis
8,209,993 B2 7/2012 Carlson
8,359,882 B2 1/2013 Al-Eidan
8,412,357 B2 4/2013 Seem
8,418,483 B2 4/2013 McSweeney
8,444,394 B2 5/2013 Koehl
8,465,262 B2 6/2013 Stiles, Jr.
8,493,014 B2 7/2013 Henderson
8,496,732 B2 7/2013 Culp
8,500,848 B2 8/2013 Claridge
8,540,493 B2 9/2013 Koehl
8,737,168 B2 5/2014 Somasundaram
8,774,978 B2 7/2014 Higgins
8,782,213 B2 7/2014 Hsu
8,783,052 B2 7/2014 Campbell
8,833,096 B2 9/2014 Campbell
8,881,541 B2 11/2014 Noll
9,038,404 B2 5/2015 Judge
9,046,900 B2 6/2015 Kates
9,081,394 B2 7/2015 Kates
9,410,752 B2 8/2016 Wallace
9,423,172 B2 8/2016 Wong
9,435,576 B1 9/2016 Scaringe et al.
2005/0006488 A1 1/2005 Stanimirovic
2005/0086959 A1 4/2005 Wilson
2005/0120729 A1 * 6/2005 Zhang ..... F25B 9/008 62/183
2005/0192680 A1 9/2005 Cascia
2005/0257543 A1 11/2005 Martin
2006/0112702 A1 6/2006 Martin
2006/0218965 A1 10/2006 Manole
2007/0107450 A1 * 5/2007 Sasao ..... F24F 11/0008 62/185
2008/0029250 A1 2/2008 Carlson
2008/0314064 A1 12/2008 Al-Eidan
2008/0315000 A1 12/2008 Gorthala
2009/0277196 A1 11/2009 Gambiana
2010/0082162 A1 4/2010 Mundy
2011/0088426 A1 4/2011 Lochtefeld
2011/0174001 A1 6/2011 Carlson
2011/0168379 A1 7/2011 Morgan
2012/0030347 A1 2/2012 Hsu
2012/0042674 A1 * 2/2012 Takenaka ..... F24F 11/30 62/185
2012/0048954 A1 3/2012 Feustel
2012/0303165 A1 11/2012 Qu
2013/0025842 A1 1/2013 Carlson
2013/0036754 A1 2/2013 Moore
2013/0098085 A1 4/2013 Judge
2013/0098086 A1 4/2013 Sillato
2013/0098087 A1 4/2013 Noll
2013/0151019 A1 6/2013 Federspiel
2013/0167560 A1 7/2013 Wong
2014/0013788 A1 * 1/2014 Kopko ..... F25B 29/003 62/324.6
2014/0033753 A1 2/2014 Lu
2014/0150483 A1 6/2014 Takayama
2014/0317281 A1 10/2014 Hsu
2015/0204595 A1 * 7/2015 Sunderland ..... F16K 25/00 165/295
2015/0267941 A1 9/2015 Kato
2015/0300892 A1 10/2015 Malhotra et al.
2015/0362408 A1 12/2015 Rosendo et al.
2016/0025364 A1 1/2016 Mills, Jr. et al.
2016/0245569 A1 * 8/2016 Unezaki ..... F24F 11/62

FOREIGN PATENT DOCUMENTS

| | | |
|---|---|---|
| CN | 201637008 | 11/2010 |
| CN | 101929716 | 12/2010 |
| CN | 101988725 | 3/2011 |
| CN | 203744429 | 7/2014 |
| CN | 203744457 | 7/2014 |
| EP | 1191287 | 3/2002 |
| WO | 2014055914 | 4/2014 |

* cited by examiner

Connections show could be either wired or wireless.

CONTINUOUSLY VARIABLE CHILLER AND CONTROL SYSTEMS, METHODS, AND APPARATUSES

CROSS-REFERENCE TO RELATED APPLICATIONS

This patent application claims the benefit of U.S. Patent Application Ser. No. 62/383,377, filed Sep. 2, 2016, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of chillers and heat pump refrigeration units. More specifically, the presently disclosed systems, methods, and/or apparatuses relate to continuously variable chiller and heat pump control systems.

2. Description of Related Art

A chiller is defined as a cooling system whereby the outdoor equipment (compressor etc.) connects to indoor equipment (air handlers, etc.) by water or other fluid circuit. For a typical chiller system, the basic design consists of a refrigeration unit with a compressor, evaporator, condenser, and a metering valve, where the evaporator section is a refrigerant-to-fluid heat exchanger connected to an aqueous fluid circuit. In a heat pump version of a chiller, a reversing valve allows the system to operate with the evaporator and condensers reversed. The fluid circuit generally includes a pump, a buffer tank, and a second pump, ultimately connected to indoor heat exchangers such as fan coil units or radiant devices. The fluid is chilled or heated as it is pumped through the refrigerant-to-fluid heat exchanger. Heat transfer fluid leaving the refrigerant-to-fluid heat exchanger is circulated into the buffer tank, and then from the tank back to the refrigerant-to-fluid heat exchanger at a higher or lower temperature. Using a 2nd pump, the fluid is circulated from the buffer tank through one or more fan coil units before returning to the tank at a higher or lower temperature. The pumps are typically single-speed and flow is controlled by flow restriction valves.

As a controls matter, a chiller system maintains a set heat transfer fluid temperature, for cooling, typically 44° F., temperature control within the loop or buffer tank is accomplished by a thermostat cycling one or more compressors on and off. Capacity control methods typically employed are on/off control, hot gas bypass, clearance volume control, multiple compressor staging control, cylinder unloading, etc.

While chillers in general have better part-load performance than a DX system, none of these approaches are as efficient as possible and much is left to be desired. Chillers that use on-off compressors waste energy by starting and stopping the compressor as a means of modulation. On-off thermostat control creates a full-speed-to-catch-up-then-overshoot-stop-start-over scenario of wasted energy. Chillers that use fixed speed fluid pumps are rarely pumping at the most efficient speed and remain at full speed when even a slight reduction in pump speed would create a major reduction in pump energy use. Using a 2nd pump and a buffer tank creates an often unnecessary primary-secondary loop and reduces system response time to a changing load condition. Flow control is often done by partially closing valves, which lowers pumping efficiency. Operating the system with a static set point for loop/buffer tank does not allow the system to be set at the best temperature due to changing conditions and loads.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application. In cases where formulas or controls processes are described it will be obvious that other formulas or controls processes could be used to achieve the same result.

BRIEF SUMMARY OF THE PRESENT DISCLOSURE

However, the typical chiller system arrangements have various shortcomings.

In various exemplary, non-limiting embodiments, the presently disclosed systems, methods, and/or apparatuses comprise a variable capacity chiller or hydronic heat pump with thermostatic climate controller, said controller with user inputs and a digital display for displaying system status, temperature, and psychrometric data, said digital display data being derived from sensor data provided by one or more each of temperature and humidity sensors located within a home, multi-occupant living facility, storage warehouse, office, or other building such as for education, government, agriculture, industrial, or religion, and utilizing the process of receiving temperature and humidity data from one or more sensors, plotting the intersection of temperature and one or more additional psychrometric measurement as a position on a digitally displayed standard psychrometric chart, with the controller further sending control information to a hydronic air conditioner or heat pump for the purpose of changing the operating parameters in response to input from a user or from calculations made based on a variance from a set point or from changes to sensor data of temperature, humidity, or other psychrometric data, said controller managing a chiller consisting of one or more each of a compressor, indoor-side heat exchanger, outdoor-side heat exchanger, a metering device, and a system controller, whereby the outdoor-side heat exchanger may be either air-to-refrigerant or water-to-refrigerant and where the indoor-side heat exchanger is of the refrigerant-to fluid type and the system is designed to heat or cool a heat transfer fluid such as water or other heat transfer fluid in further communication with an indoor heat exchanger(s) and where one or more of the compressor, fan, and circulating pump are of the variable speed type and are controlled such that the unit attempts to maintain a proscribed ΔT proscribed entering or leaving heat transfer fluid temperature, and flow rate, and where the proscribed setting for heat transfer fluid temperature can be automatically varied in real time based on psychrometric data received from one or more of temperature, hygrometer, or relative humidity or on information derived from such sensors, so as to vary the leaving temperature in accordance with defined psychrometric and operating goals.

In various exemplary, non-limiting embodiments, the presently disclosed systems, methods, and/or apparatuses may but do not necessarily include one or more indoor fan coil units or air handlers under control of the chiller control system.

In various exemplary, non-limiting embodiments, the presently disclosed systems, methods, and/or apparatuses comprise a variable capacity chiller or hydronic heat pump with a variable speed compressor and variable speed pump and variable or multi-speed condenser fan where system capacity is controlled by adjusting the speed of the variable speed components based on the flow rate and ΔT between the returning water temperature and leaving water temperature, where the ΔT and flow rate indicate the load or changing load conditions and where the compressor, pump and fan adjust automatically to match the changing load conditions so as to match the capacity to the load, and which may include a psychrometric climate controller, said controller with sensors, user inputs, said controller managing a chiller or chiller designed to heat or cool a heat transfer fluid such as water or other heat transfer fluid in further communication with an indoor heat exchanger(s) and where the proscribed setting for the entering or leaving heat transfer fluid temperature can be automatically varied in real time based on psychrometric data received from one or more of temperature, hygrometer, or relative humidity or on information derived from such sensors, so as to vary the leaving temperature and flow rate in accordance with defined psychrometric goals, and further, when in heating mode, to dynamically manage an external backup resistance heat source by modulating its capacity to accurately match any shortfall of heating capacity.

In various exemplary, non-limiting embodiments, the presently disclosed systems, methods, and/or apparatuses comprise a variable capacity hydronic heat pump system, including at least some of a controller; an outdoor-side heat exchanger which may be of the refrigerant-to-air type, or refrigerant-to-water type, or a hybrid combination of both types; a compressor; a metering device; a reversing valve; a pump; an indoor-side refrigerant-to-water heat exchanger; and one or more indoor heat exchangers, wherein the indoor-side refrigerant-to-water heat exchanger is coupled of connected to the indoor heat exchangers, wherein each indoor heat exchangers comprises of a fan with a coil device, or a radiant device, or other device designed to emit or absorb heat from an environment; and which coupled of connected to a distribution loop or distribution means that may be further coupled or in fluid communication with, or intended to be coupled or in fluid communication with, one or more indoor heat exchangers, said loop comprising supply side piping or tubing in fluid communication with the heat pump outlet supply and in fluid communication with the inlet of one or more indoor heat exchangers and configured such that the outlet of the indoor heat exchangers is in fluid communication with the return side of the loop also comprising piping or tubing which is in fluid communication with the heat pump inlet return, such that heat pump serves the heating or cooling requirements of the heat exchangers, where a heat transfer fluid is pumped through the indoor-side refrigerant-to-water heat exchanger to be chilled or heated by adding or removing heat from the fluid and where the fluid then exits the indoor-side refrigerant-to-water heat exchanger, and where the indoor-side refrigerant-to-water heat exchanger outlet is further connected to a distribution loop connecting to indoor heat exchangers or provide indoor cooling or heating by absorbing or releasing heat from an indoor cooling or heating load and add or subtract heat from the fluid, and where a supply and return path of the loop is used such that the fluid that has been cooled or heated in the indoor heat exchanger(s) is then returned back to the heat pump at a warmer or cooler temperature, to be heated or cooled, and where the compressor and pump are both of the variable speed type, and where the compressor speed and pump speed are controlled and modulated to target a specific BTU of cooling or heating, and where the compressor speed is controlled so as to cause the leaving or returning water temperature to match a set point and where the pump is controlled to modulate its speed based on targeting a consistent ΔT between the fluid temperature as it exits the indoor-side refrigerant-to-water heat exchanger as compared to the temperature of the fluid as it returns back to the inlet of the indoor-side refrigerant-to-water heat exchanger, and where the compressor speed is modulated based on matching a set point target of either the leaving or returning fluid, such that the variable speed pump and compressor speed up and slow down as needed to match the immediate capacity of the heat pump to the immediate indoor heating or cooling load as the load may change, and where in certain iterations the system may have no reversing valve and therefore be capable of cooling-only or heating-only and would not be able to do both.

In various exemplary, non-limiting embodiments, an indoor controller provides a user interface which may be comprising a digitally displayed psychrometric chart, and where such controller may further show the current psychrometric condition as a marked position or location on a psychrometric chart, and where such chart may further include a non-user definable pre-configured recommended operating zone bounded by any two or more boundaries of temperature, humidity, relative humidity, wet bulb, condensation point, absolute humidity, said boundaries pre-configured as region on a chart display, and where said controller may provide a user the ability to change settings of system operation and/or monitor performance of the system, and where such controller may further connect to indoor equipment, one or more sensors, to the system outdoor equipment, or to other devices either by wired connection or wirelessly, or provide user or others to access to such controller through the internet.

In various exemplary, non-limiting embodiments, an included or associated backup heating system may be controlled in a variable manner and where such system is comprising at least one each of a controller within or in communication with the heat pump, such controller further able to communicate with temperature sensors and/or flow sensors, an SSR, SCR or other type of power modulation or switching device that can control or limit the voltage or amperage of electrical power provided to the resistance heating element thus controlling the output of such heating element, a resistance heating element within or constituting a flow-through enclosure or vessel attached in-line or in fluid communication with the supply side of the loop after the heat pump outlet and prior to entering any heating loads, where the resistance heating element is situated such that loop fluid can flow across or through the resistance heating element and the fluid can be heated, where the output in watts or BTU of the resistance heating element can be controlled by the system to target an accurate match to any BTU or temperature shortfall of heating capacity of the heat pump, and where the heat pump is in control of, or receiving quantitative input from, the backup heating system, where the heat pump system is either directly, or indirectly through a controller, controlling the amount of backup heat added to the loop by the resistance element, or receiving data showing the amount of backup heat added to the loop for purposes of load and/or capacity calculation.

In various exemplary, non-limiting embodiments, at least one valve operated with at least tank or heat exchanger tank, or at least one valve operated with at least one additional loop, where either, or both, or multiples of each, may be used within or in conjunction with the distribution loop, where such valves are controlled by the heat pump, where such valves may allow the heat pump to provide heating or cooling to more than a single distribution loop, or tank, or heat exchanger tank, and where the heat pump may have the ability to operate such additional loop or tank or heat exchanger tank at a different target temperate that is used for the main loop or other loop or tank or heat exchanger tank associated with the loop.

In various exemplary, non-limiting embodiments, rather than being comprising a compressor and metering device, and using a refrigerant, the heat pump may instead may use one or more of a solid-state heating or cooling device such as a thermoelectric or magnetocaloric heat transfer device, and, a heat transfer fluid which may be a refrigerant or other type of heat transfer fluid used in place of the refrigerant, and a pump or a thermosiphon design to move the heat transfer fluid in recirculating manner through the heat exchangers, and where the system is then used to add or remove heat from a fluid as it is transiting the indoor-side heat exchanger.

In various exemplary, non-limiting embodiments, the system may include a pre-cooling heat exchanger apparatus for the purposes of "free cooling" on the inlet side of the indoor-heat exchanger where fluid of the loop is passed through a fluid-to-air coil and fan apparatus before entering the system such that in low ambient conditions the fluid may be pre-cooled prior to entering the system.

In various exemplary, non-limiting embodiments, the controller has additional inputs connected to sensors or data sources that may signal a potential or impending sensible or humidity condition change, such as notification of a door opening, power consumption increase or decrease, motion sensor, weather station data, the on/off or fan speed rate of a fan or blower system, fan coil or indoor heat exchanger status, or other input for the purpose of making advance system setting adjustments in anticipation of a change in cooling or heating load or change of humidity.

Accordingly, the presently disclosed systems, methods, and/or apparatuses separately and optionally provide continuously variable chillers or chiller heat pumps.

The presently disclosed systems, methods, and/or apparatuses separately and optionally provide improved chiller control.

These and other aspects, features, and advantages of the presently disclosed systems, methods, and/or apparatuses are described in or are apparent from the following detailed description of the exemplary, non-limiting embodiments of the presently disclosed systems, methods, and/or apparatuses and the accompanying FIGS. Other aspects and features of embodiments of the presently disclosed systems, methods, and/or apparatuses will become apparent to those of ordinary skill in the art upon reviewing the following description of specific, exemplary embodiments of the presently disclosed systems, methods, and/or apparatuses in concert with the FIGS. While features of the presently disclosed systems, methods, and/or apparatuses may be discussed relative to certain embodiments and FIGS., all embodiments of the presently disclosed systems, methods, and/or apparatuses can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the presently disclosed systems, methods, and/or apparatuses.

Any benefits, advantages, or solutions to problems that are described herein with regard to specific embodiments are not intended to be construed as a critical, required, or essential feature(s) or element(s) of the presently disclosed systems, methods, and/or apparatuses or the claims.

BRIEF DESCRIPTION OF THE SEVERAL VIEWS OF THE DRAWINGS

As required, detailed exemplary embodiments of the presently disclosed systems, methods, and/or apparatuses are disclosed herein; however, it is to be understood that the disclosed embodiments are merely exemplary of the presently disclosed systems, methods, and/or apparatuses that may be embodied in various and alternative forms, within the scope of the presently disclosed systems, methods, and/or apparatuses. The FIGS. are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following FIGS., wherein like reference numerals refer to like parts throughout the several views, unless otherwise described, drawings are shown with the CVCC operating in cooling-mode, a person skilled in the art will easily understand the heating mode operation is the opposite or reverse action of cooling mode, and wherein.

DETAILED DESCRIPTION OF EXEMPLARY EMBODIMENTS OF THE PRESENT DISCLOSURE

Figure 1:
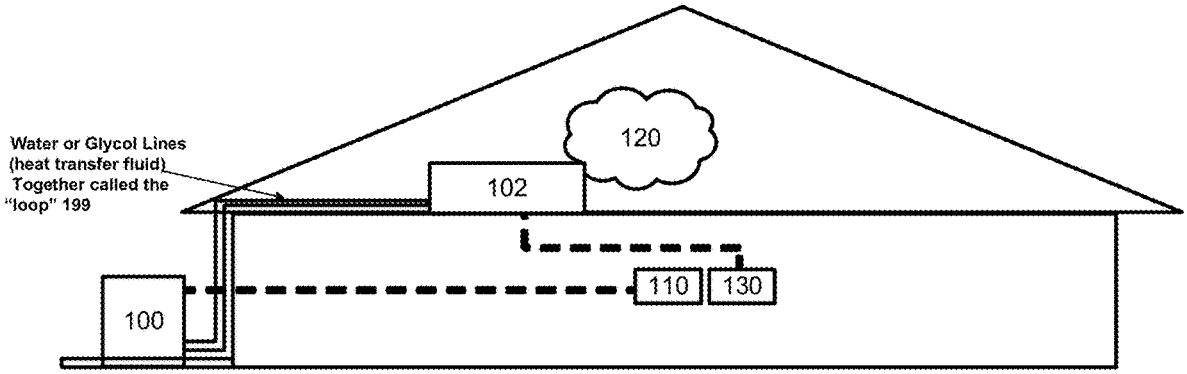
FIG. 1 illustrates an exemplary embodiment of the continuously variable chiller and control system, according to the presently disclosed systems, methods, and/or apparatuses, wherein the CVCC outdoor unit connects to an air handler located within a duct system by a supply and return fluid line (aka "the loop"), and is connected to an indoor controller, and wherein the air handler fan speed tec. is managed by a conventional thermostat.

For simplicity and clarification, the design factors and operating principles of the continuously variable chiller and control according to the presently disclosed systems, methods, and/or apparatuses are explained with reference to various exemplary embodiments of a continuously variable chiller and control according to the presently disclosed systems, methods, and/or apparatuses. The basic explanation of the design factors and operating principles of the continuously variable chiller and control is applicable for the understanding, design, and operation of the continuously variable chiller and control system of the presently disclosed systems, methods, and/or apparatuses. It should be appreciated that the continuously variable chiller and control can be adapted to many applications where a continuously variable chiller and control system can be used.

Unless otherwise described in the description or drawing, it can be assumed that the CVCC is operating in cooling mode. It will be obvious to an experienced practitioner that heating control would work the same way but temperatures, ΔTs, etc. work in the opposite direction. Further, where dotted lines are shown to indicate control or sensor connections, these may show an arrow pointing in one direction however in many cases it will be obvious that many of these connections are bi-directional and therefore the "direction" indicated by any such arrow can be ignored as not irrelevant and are designed to show a control or sensor connection that may be but does not have to be bi-directional.

As used herein, the word "may" or "can" is meant to convey a permissive sense (i.e., meaning "having the potential to"), rather than a mandatory sense (i.e., meaning "must"). Unless stated otherwise, terms such as "first" and "second" are used to arbitrarily distinguish between the exemplary embodiments and/or elements such terms describe. Thus, these terms are not necessarily intended to indicate temporal or other prioritization of such exemplary embodiments and/or elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "continuously variable chiller and control system", "chiller", "air conditioner", and "heat pump" are used for basic explanation and understanding of the operation of the systems, methods, and apparatuses of the presently disclosed systems, methods, and/or apparatuses. Therefore, the terms "continuously variable chiller and control system", "chiller", "air conditioner", and "heat pump" are not to be construed as limiting the systems, methods, and apparatuses of the presently disclosed systems, methods, and/or apparatuses. The terms "water" and "fluid" may be used interchangeably and according to context may have the same meaning.

In various exemplary, nonlimiting embodiments, the design and production of the described system should be reproducible by a person skilled in the art of designing air conditioners and heat pumps, particularly hydronic systems, and controls thereof. However, in certain exemplary embodiments/iterations, testing and logging is needed for the system to be adapted to different sizes/brand/models of compressor, new combinations of compressor, heat exchangers, valves, etc.

Turning now to the appended drawing figures, FIGS. 1-16 illustrate certain elements and/or aspects of an exemplary embodiment of the Continuously Variable Chiller & Control System (CVCC), according to the presently disclosed systems, methods, and/or apparatuses. Components or steps are numbered such that, where possible, the beginning number explains the drawing number where it is first described such that "401" would first appear on FIG. 4, and "550" would first appear on FIG. 5, and, where an "S" indicates a step in a process rather than a component. For better explanation of the system we may address some FIGS. in logical but non-numerical order.

FIG. 1 illustrates an overview of the system whereby the chiller 100 is connected to a hydronic air handler 102 that is installed into duct system 120 and connected to chiller 100 by loop 199 which comprises tubing or piping, such that chiller 100 has an outlet 1230 to the supply side of loop 199 and a return path back to the inlet 1240. Also shown is a standard thermostat 130 that controls the air handler 102 fan and indoor controller 110 that can serve as a user interface and display to manage the chiller 100 as well as to collect and process various psychrometric information derived from its internal sensor 1305 for purposes of signaling commands to chiller 100. In some iterations, internal sensor 1305 may also located outside of controller 110, installed in another location, and connected back to controller 110 by wiring. In this example chiller 100 sends out, via loop 199, in the case of cooling, cold water which is returned to chiller 100 as warmer water, or in the case of heating mode, as warmer water that is returned to chiller 100 at a lower temperature.

Figure 2:
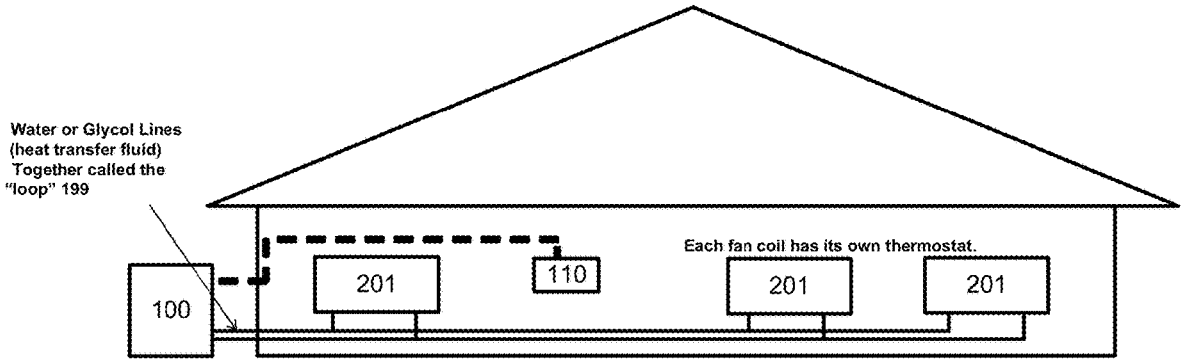
FIG. 2 illustrates an exemplary embodiment of the continuously variable chiller and control system, according to the presently disclosed systems, methods, and/or apparatuses, wherein the CVCC outdoor unit connects to individual room air handlers by a supply and return fluid line, and is connected to an indoor controller, and wherein each fan coil air handler fan speed etc. is managed by its own thermostat.

FIG. 2 illustrates an overview of the system whereby the chiller 100 is connected to one or more room fan coil units 201 that are installed to create a "ductless" installation and connected to chiller 100 by loop 199 which consists of tubing or piping, such that chiller 100 has an outlet 1230 to the supply side of loop 199 and a return path back to the inlet 1240. Also shown controller 110 that can serve as a user interface and display to manage the chiller 100 as well as to collect and process various psychrometric information derived from its internal sensor 1305 for purposes of signaling commands to chiller 100. In some iterations, internal sensor 1305 may also located outside of controller 110, installed in another location, and connected back to controller 110 by wiring. Each fan coil unit (FCU) has its own internal thermostat for operational control. In this example chiller 100 sends out, via loop 199, in the case of cooling, cold water which is returned to chiller 100 as warmer water, or in the case of heating mode, as warmer water that is returned to chiller 100 at a lower temperature.

Figure 3:
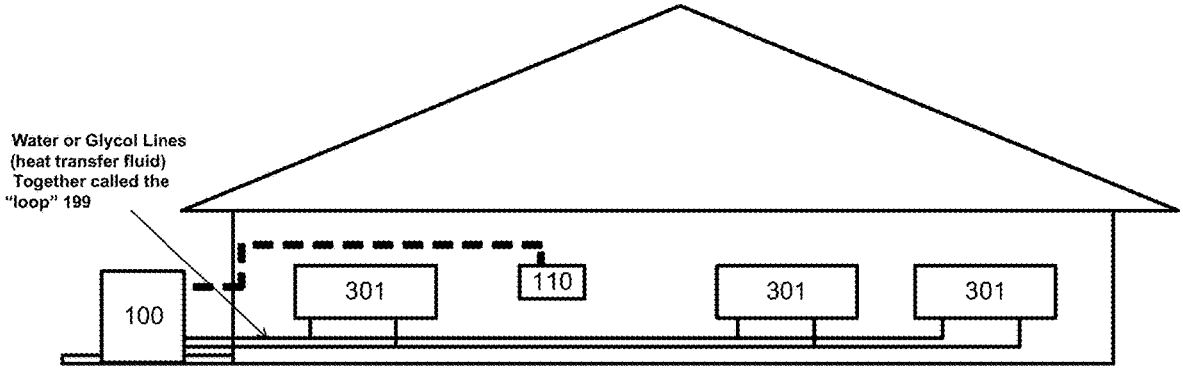
FIG. 3 illustrates an exemplary embodiment of the continuously variable chiller and control system, according to the presently disclosed systems, methods, and/or apparatuses, wherein the CVCC outdoor unit connects to radiant panels by a supply and return fluid line, and is connected to an indoor controller, and wherein operation of the radiant panels is managed by its own thermostat.

FIG. 3 illustrates an overview of the system whereby the chiller 100 is connected to one or more radiant panels 301 that are installed to create a radiant heating or cooling installation and connected to chiller 100 by loop 199 which consists of tubing or piping, such that chiller 100 has an outlet 1230 to the supply side of loop 199 and a return path back to the inlet 1240. Also shown controller 110 that can serve as a user interface and display to manage the chiller 100 as well as to collect and process various psychrometric information derived from its internal sensor 1305 for purposes of signaling commands to chiller 100. In some iterations, internal sensor 1305 may also located outside of controller 110, installed in another location, and connected back to controller 110 by wiring. Each radiant panel or group of panels has its own $3^{rd}$ party thermostat for operational control. Further, where illustrates "panels" this could also be an in-floor or in-wall installation that does the same thing as panels. In this example chiller 100 sends out, via loop 199, in the case of cooling, cold water which is returned to chiller 100 as warmer water, or in the case of heating mode, as warmer water that is returned to chiller 100 at a lower temperature.

Figure 4:
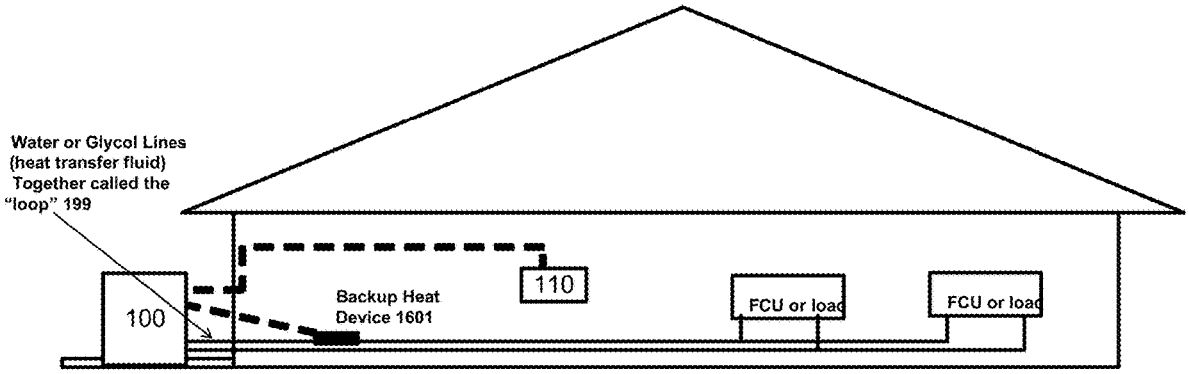
FIG. 4 Illustrates an exemplary embodiment of the continuously variable chiller and control system, according to the presently disclosed systems, methods, and/or apparatuses, wherein the CVCC outdoor unit connects to indoor heat exchange equipment of any type(s) such as FCU, Air Handler or radiant panels, by a supply and return line, and where there is a backup heating device located in-line on the supply line, the backup heat device is connected to the CVCC for control purposes.

FIG. 4 illustrates an example of chiller 100 operating in heating mode using backup heat device 1601 located in-line on chiller outlet-side of loop 199 further connecting to indoor equipment, in this FIG., fan coils 201 as explained in FIG. 1. However it should be noted that the backup heat device 1601 could be installed in loop 199 in the same location when loop 199 further or alternatively connects to hydronic air handler 102, or to radiant panels 301, or to fan coils 201 as shown, or when using any combination of indoor equipment 102, 201, or 301. In this example chiller 100 in heating mode sends out, via loop 199, warm water that may be, as needed, further heated by device 1602.

Figure 14:
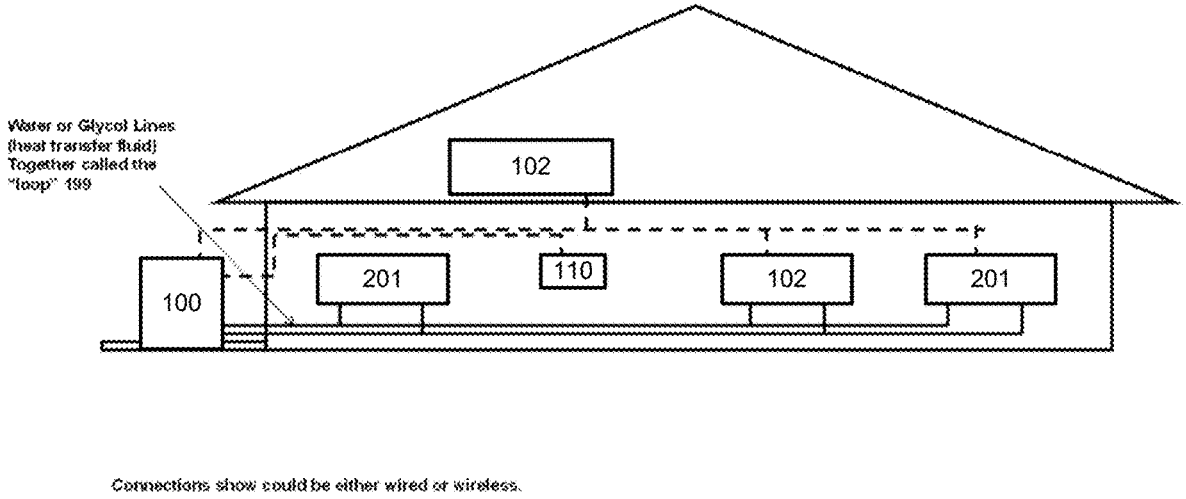
FIG. 14 illustrates an exemplary embodiment of a CVCC system configuration where the CVCC controller is managing the indoor equipment, shown are both fan coil units and air handler, either or both type, as well as radiant panels, could be used according to the presently disclosed systems, methods, and/or apparatuses.

FIG. 14 illustrates an overview of a system whereby the chiller 100 is connected to a hydronic air handler 102 that is installed into duct system 120 and connected to chiller 100 by loop 199 which consists of tubing or piping, such that chiller 100 has an outlet 1230 to the supply side of loop 199 and a return path back to the inlet 1240. This FIG. further illustrates that the indoor equipment, which could be items 102, 201, 301 or any combination thereof, can be connected by wires or wireless means, for purposes of controls or data exchange, to either chiller 100 or to controller 110.

Figure 12:
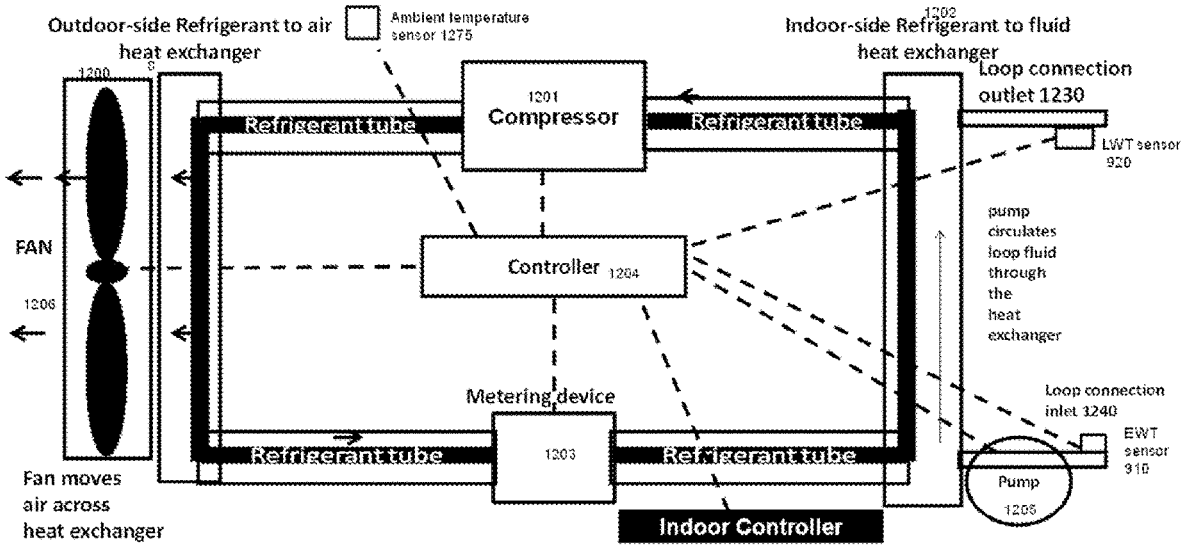
FIG. 12 illustrates an exemplary embodiment of various exemplary components of a chiller, according to the presently disclosed systems, methods, and/or apparatuses.

FIG. 12 illustrates a non-limiting example of the refrigeration components of a chiller 100 where a typical refrigeration cycle, as may be used with the CVCC, consists of a compressor 1201, an outdoor-side heat exchanger 1200, condenser fan 1206, metering device 1203, and indoor-side heat exchanger 1202, further controller by at least controller 1204, and illustrates pump 1205 connected in-line prior to inlet 1204. Water or heat transfer fluid to be heated or cooled enters the chiller 100 through the loop connection inlet, passes through heat exchanger 1202, and leaves the chiller 100 through loop connection outlet 1230. Drawing also illustrates EWT sensor 910 and LWT sensor 920. Pump 1205 pumps water from loop 199 through indoor-side heat exchanger 1202 and back to loop 199. It should be noted that pump 1205 could also be connected to the outlet side 1230 and would have the same effect of pumping the water through loop 199, and through heat exchanger 1202. Also shown is ambient temperature sensor 1275 which measures outdoor temperature.

Figure 8:
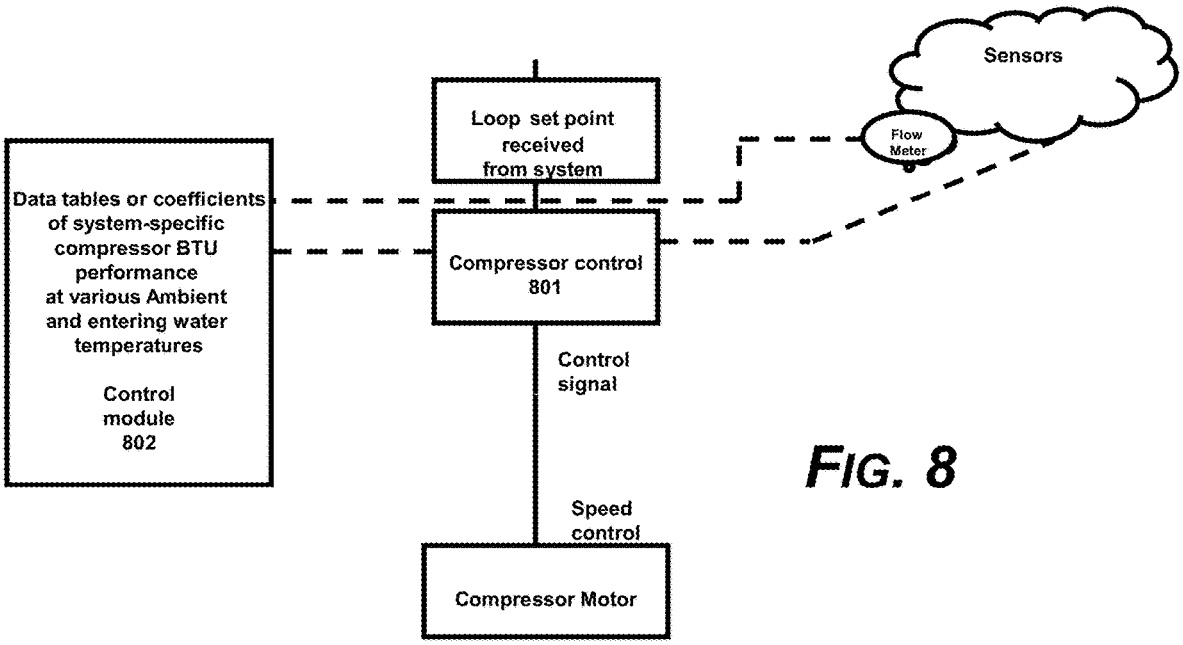
FIG. 8 illustrates an exemplary embodiment/iteration of capacity-based variable speed compressor control, according to the presently disclosed systems, methods, and/or apparatuses; in this example data tables or coefficients are used to provide compressor speed settings.

FIG. 8 illustrates details related to compressor controls where the compressor controller 801 receives a set point signal from the chiller 100 controls system. The compressor controller 801, using information from sensors, in this first example using LWT sensor 920, and using feedback control logic, increases or decreases the compressor speed as a function of set point error. For example, in cooling mode, if LWT set point is 45° F. and LWT sensor 920 illustrates 50° F., the error from set point is 5° F. In this case the compressor 1201 would increase speed until the error narrows, using PID or other feedback control means of controller 801 which will attempt to find a compressor speed setting that lets LWT sensor 920 temperature be equal to the set point.

FIG. 8 also illustrates optional connections to control module 802 where control module 802 stores lookup tables and/or uses coefficients to send a speed signal to the compressor. In the case where control module 802 is used, it uses information from sensor 910 and 920, flow meter 1010, and from and ambient sensor 1275 to see the current conditions. Within the lookup tables and/or coefficients, for each combination of ambient temperature, flow rate, and EWT, there is a corresponding compressor speed needed for each BTU needed. The needed BTU calculation is further explained elsewhere herein. For example, from testing and data logging, it may be known that compressor 1201 can produce 12000 BTU at 8,000 (RPM) under the current EWT and flow rate and ambient temperature of 95° F., but BTU values may be only 10500 BTU, at the same RPM if for example, ambient were 100° F., likewise, BTU values at the given EWT and flow rate may be higher than 13500 BTU if ambient were only 90° F. Differences in EWT, LWT, and flow rate may also cause the same RPM to produce different BTU values, likewise in some examples differing RPMs may produce the same BTU values. For every possible combination of EWT, flow rate, and ambient within the operating range, there will be a BTU value associated with each step in compressor speed. In this manner compressor speed can quickly bet set upon a change in sensed conditions without using feedback control.

Further, in a third example both prior described methods may be used together in a two-step controls process that may be employed whereby after first using control module 802 data to set a compressor speed, controller 801 may then "fine tune" the compressor speed by using PID or feedback control as first described to override output of controller 802 for greater accuracy.

Thus, the system may be operated with or without using controller 802.

Figure 9:
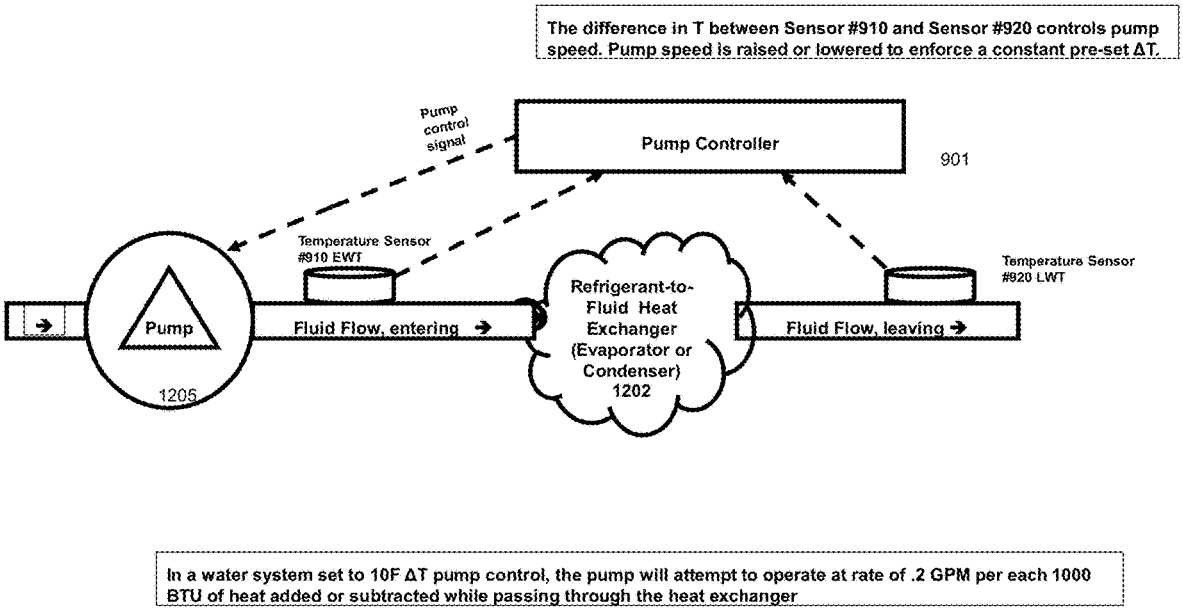
FIG. 9 illustrates an exemplary embodiment/iteration of ΔT pump control, according to the presently disclosed systems, methods, and/or apparatuses.

FIG. 9 details a controls process for pump 1205 whereby pump controller 901 receives temperature sensor data from sensors 910 and 920, and compares the difference between them to produce a ΔT, then using feedback control, adjusts the speed of pump 1205 upwards or downwards, as needed, to match the sensed ΔT to the preset ΔT set point. For example, in cooling mode, where the ΔT set point is 10° F., we may see conditions such as EWT of sensor 910 at 55° F. and LWT of sensor 920 at 45° F., the controller 901 would make no adjustment because the ΔT is 10° F. However if conditions change such that, for example EWT changes to 54, controller would notice that the ΔT is now 9° F. and would slow the pump a little using feedback control, until ΔT is 10° F. This controls means produces a flow rate of 2.4 gallons per minute per ton when using water. Flows are adjusted dynamically as the specific heat of the fluid changes. For example when a fluid has 10% propylene glycol the specific heat is no longer 1.0, it is 0.98, therefore to maintain the 10° F. ΔT the pump would flow at 2.47 GPM per ton.

Figure 10:
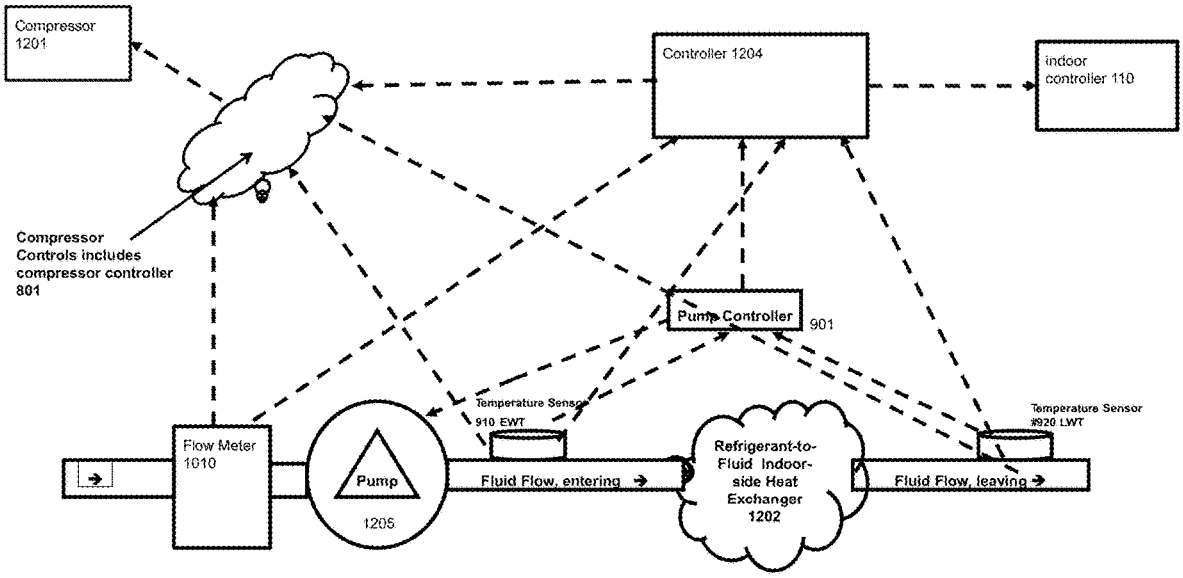
FIG. 10 illustrates an exemplary embodiment/iteration with capacity-based compressor/pump speed control according to the presently disclosed systems, methods, and/or apparatuses.

FIG. 10 illustrates a wider angle view of items explained by FIGS. 8, 9 and 12 showing how the essential part of these various FIGS. relate to each other.

Figure 13:
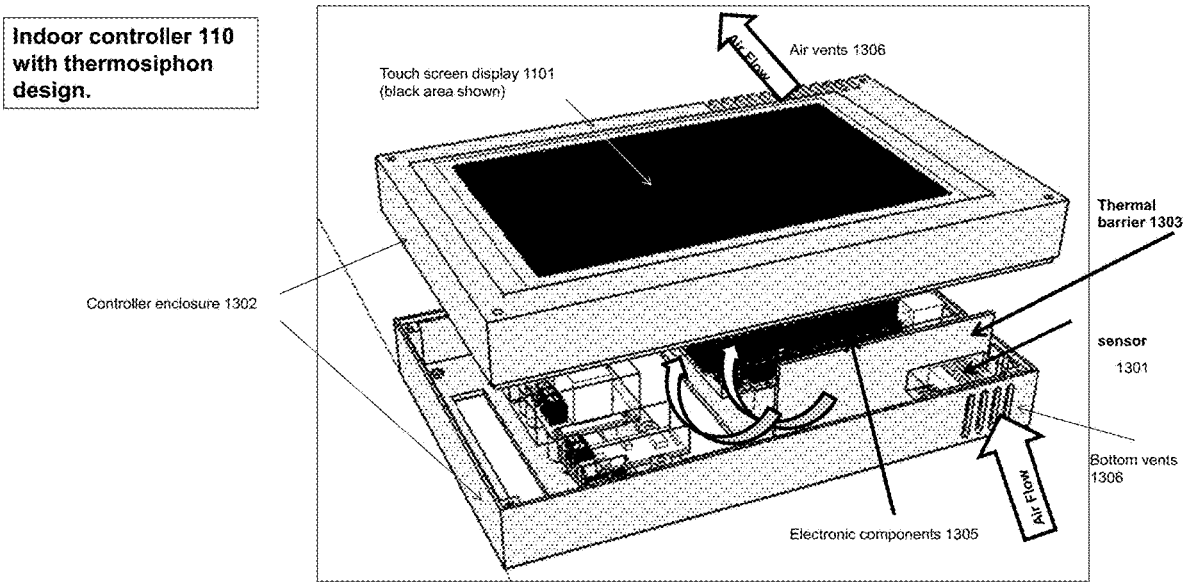
FIG. 13 illustrates an exemplary embodiment of a controller with thermosiphon design, according to the presently disclosed systems, methods, and/or apparatuses; and illustrates the air flow path of the device.

As illustrated, for example, in FIG. 13, the indoor controller 110 may further use an indoor controller enclosure 1302 design that incorporates a "thermo-siphon effect" such that an internal temperature/humidity sensor or other environmental sensor (sensor 1301) is located in a bottom area of the enclosure and is thermally isolated by a thermal barrier 1303 (an interior "wall" insulated and/or with attached reflective material on the hot side) to thermally isolate the sensor 1301 from the heat producing electronics which are located above it, to prevent heat from electronics from skewing of sensor readings. The thermal effects of the electronics 1305 produce a warmer air which rises and exits from vents cut into the "top" vents 1306 (when wall mounted) of the enclosure, this process creates an upward flow of warmer air, which draws in room air through the bottom vents 1307. Entering air is channeled to pass the air flow across the sensor 1301 immediately upon entering the enclosure for greater accuracy of environmental readings. This design cools the electronics, isolates the sensor from the electronics thermal output, and provides a steady flow of room air drawn across the sensor. Controller 110 may offer various means to import or export data or controls signals by wired or wireless means.

Figure 11:
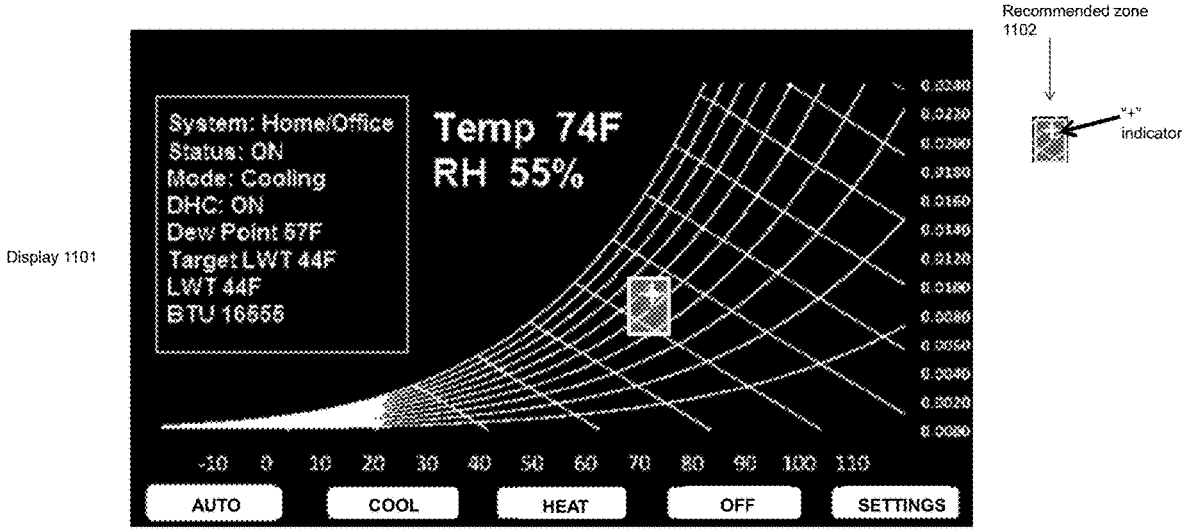
FIG. 11 illustrates an exemplary embodiment of an indoor controller main screen, according to the presently disclosed systems, methods, and/or apparatuses.

As illustrated, for example, in FIG. 11, the controller 110 illustrates and example of a touch-screen controls interface and display 1101 and through the touch controlled display settings, modes, parameters etc. of the chiller 100 and its associated components can be managed and status displayed. Also, display 1101 may also offer various views that can be toggled by the user showing real time, historical, or averages, of one or more of the following: temperature, humidity, condensation point, enthalpy, absolute humidity, wet bulb, BTU, COP, EER, Compressor Frequency, power utilization, GPM, EWT, LWT, fan speed, pump speed or any other data collected during the operation of the chiller 100. The display 1101 may also contain a factory-defined recommended zone defined by any two or more boundaries of psychrometric values such as temperature, humidity, relative humidity, wet bulb, absolute humidity, etc. said boundaries may be pre-configured as a region on the chart display. (To help understand the FIG. 11 drawing, "recommended zone" is shown as a rectangular box near the center with a "+" inside the box). The "+" indicator 1103 indicates the current psychrometric condition.

Figure 5:
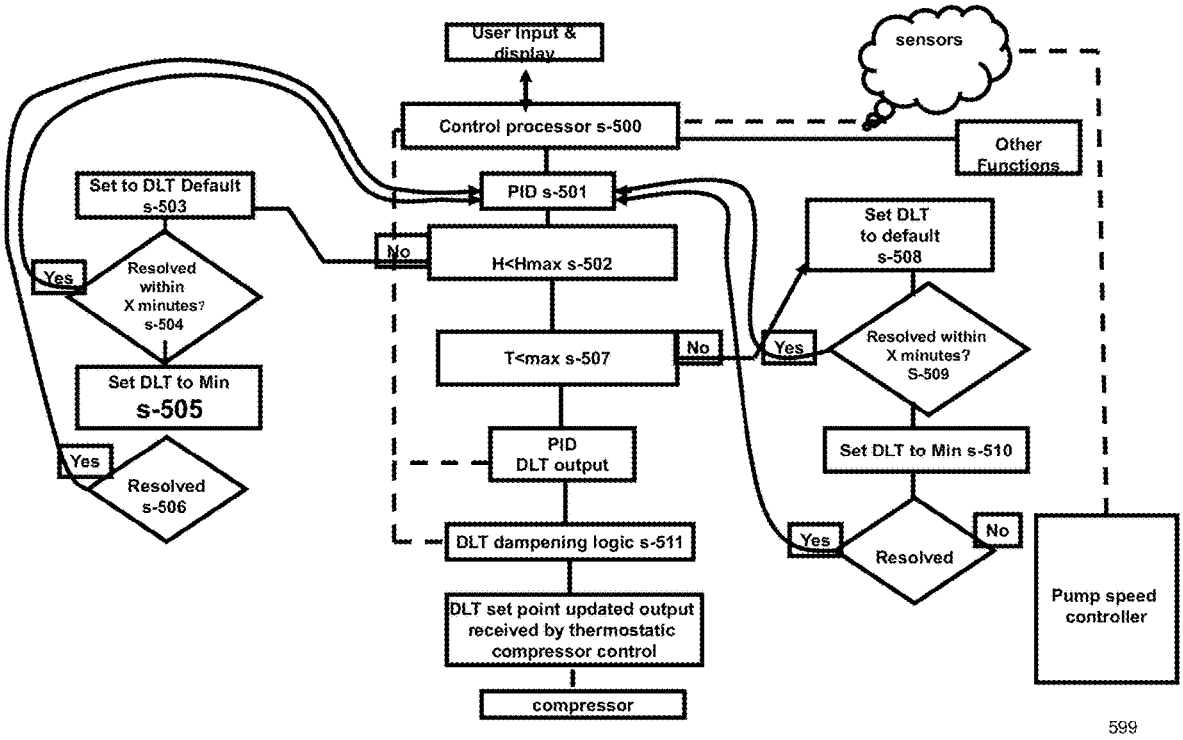
FIG. 5 illustrates an exemplary embodiment/iteration of controller function, according to the presently disclosed systems, methods, and/or apparatuses; illustrates an exemplary embodiment/iteration of CVCC system with controller basic capacity controls, with added DLT (dynamic loop temperature) functions.
Figure 6:
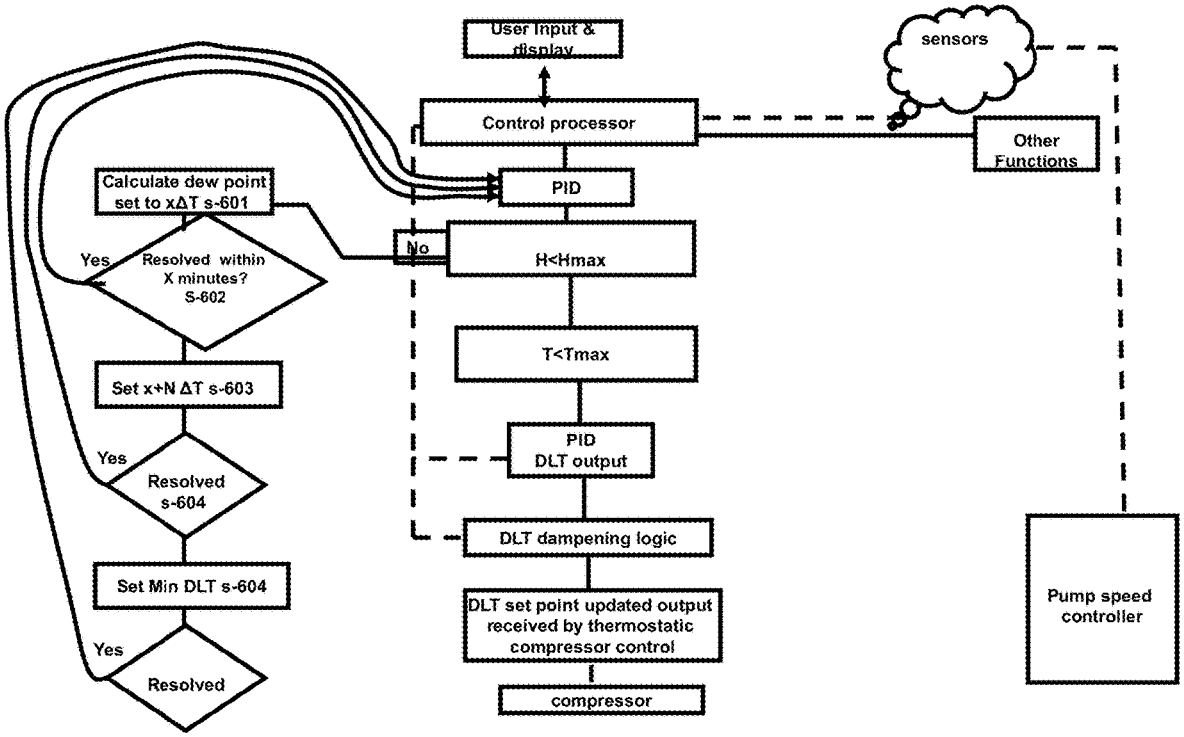
FIG. 6 illustrates an exemplary embodiment/iteration of CVCC system with controller basic capacity controls, with added DLT (dynamic loop temperature) functions using condensation point calculations, according to the presently disclosed systems, methods, and/or apparatuses.

FIGS. 5, 6, etc. can be easily understood by the associated labels and by knowing that "DLT" means dynamic loop temperature, "H" means humidity, "MaxH" (or "Hmax") means maximum allowed humidity (relative humidity), "T" means temperature, and MaxT (or "Tmax") means maximum allowed temperature. MaxH and MaxT are user defined set points.

FIG. 5 illustrates the control steps used for dynamic control of loop 199 LWT (leaving water temperature). Dynamic loop temperature (DLT) is a LWT target that has been modified based on the need to start, or increase, decrease, or stop the level of, dehumidification performed indoors. For background, only when LWT (or DLT) is below the indoor condensation point, will dehumidification occur, but sensible cooling can be accomplished regardless of whether LWT or DLT are above or below the condensation point. A CVCC system operating at a LWT at any allowed F within its range can perform sensible cooling but can only perform dehumidification when the LWT is below the condensation point. A spike in indoor humidity will cause the system to dynamically lower the LWT until the indoor humidity condition is cured and then return back to a warmer temperature after the condition is cured. For example, an influx of humid air into a conditioned space caused by a door opening to the outside may raise the indoor RH to a point where it exceeds a user-define maximum allowed indoor RH set point. In this example the CVCC would react by lowering the loop 199 operating temperature to provide, or increase the level of, dehumidification and when the humidity is back within the allowed range, allow the loop 199 temperature to rise back to a more efficient temperature. It should be noted that CVCC system is a machine whose job is one of using mechanical force to remove heat from water, a warmer loop 199 temperature is more efficient simply because it takes less work or energy to remove heat from warmer water than from cooler water. The CVCC is thus designed to use a warmer loop when possible, and will cool the loop no further than required by conditions.

Beginning now in FIG. 5 we use a pre-defined default loop temperature set point established within control step S-500 where the system uses sensor input from various sensors to manage loop 199 temperature (the LWT or DLT of the system). In the case of DLT the LWT set point is dynamically modified based on output from controller 110 using information from sensor 1301 as described elsewhere herein and sent to controller processor is step S-501.

In this FIG. 5 explanation we will focus on DLT function. DLT function is such that the LWT set point is dynamically changed to effect changes to the temperature of the supply side of loop 199. The driver of this action is the variance between psychrometric goals and psychrometric sensor readings such as indoor humidity and temperature operates as calculated by the system. Dehumidification is progressively stronger as the LWT is reduced below the condensation point, at such time as the LWT is below the condensation point. When for example H (indoor humidity) is above Hmax (the user-defined maximum allowed humidity) the LWT set point is modified such that the LWT will reduce its temperature setting to provide increased latent heat removal (dehumidification). This is a process of lowering the LWT temperature until an increase in dehumidification has resolved the H>Hmax condition. In a condition where step S-502 sees that H is >Hmax, the first step of S-503 is to change the LWT (DLT) to a default setting. In this case the default setting may be, for example, defined as 50° F. At 50° F. LWT, the LWT should be low enough to resolve this H>Hmax under most conditions. For example where Hmax set point is 59% and indoor RH reaches 60%, DLT would take over per step S-503 and invoke a change to LWT lowering it to the default DLT setting of LWT 50° F. When RH is 60% and indoor temperature is at 75° F., the indoor condensation point will be 60° F. When LWT (DLT) is at 50° F. and the condensation point is at 60° F., the LWT is therefore 10° F. below the condensation point and dehumidification will occur, reducing indoor humidity. If the H>Hmax condition is resolved within x minutes per S-504, control of LWT is released back to PID S-501. If after x minutes per S-504 the H>Hmax condition persists, the LWT (DLT) will be further lowered per S-505 to the lowest allowed setting which for example may be LWT 40° F. and remain there until the H>MaxH condition is resolved and when resolved S-506 will release LWT control back to PID control. In this manner, when humidity exceeds the maximum allowed setting, the LWT is reduced until the humidity condition is within the allowed range and then the LWT is allowed to rise again. The LWT set point is dynamically modified based on input to control step S-500 such that it may override the PID as shown is S-501. In step S-502, Hmax is set to an upper limit of allowable humidity and actual humidity is reported by sensor 1301 and controller 110.

The design is such that the LWT/DLT will be allowed to rise as high as possible within the allowed range, for example, DLT may be allowed to rise as high as 60° F. However, at certain conditions such when LWT or DLT is as high as for example 60° F., under certain conditions, indoor heat exchangers may not be able to keep up with the sensible cooling load as further explained elsewhere. This condition would be noticed when step S-507 sees that T (indoor temperature) is above Tmax (maximum allowed indoor temperature) shown in FIG. 5 at T>Tmax.

In step S-507, if T>Tmax the controls will reset the LWT/DLT to a lower "default' temperature as has been pre-defined by the user. If the T>Tmax condition is resolved per step S-509 within x minutes, control is released back to the system. But if after x minutes T>Tmax condition has not been resolved, DLT will be reset to the lowest allowed temperature per step S-510. When resolved, control is returned to the system. It should be noted that where illustrates two steps on DLT H control, there could be as many as desired in order to make the changes more granular.

Once resolved, the control provides further control called dampening logic step S-511. When conditions are such that humidity has been dealt with and DLT can be raised, the system will prevent DLT from rising too quickly. If the DLT is allowed to rise too quickly, then colder water in the loop 199 could reach the EWT sensor 910 at a temperature low enough that compared to the newly revised loop 199 temperature target, would indicate a loss of load and cause compressor 1201 to slow or stop which may be undesirable. Therefor a limiting means is incorporated into S-511, a "soft landing" feature called dampening logic S-511, which may be a timer or may work on hysteresis at step S-511. If hysteresis is used, it may be set such that DLT cannot be lowered further than EWT (LWT+10° F.)+2° F. to keep the system stable while the loop sheds excess temperature. If a timing approach is used at S-511, it may require that changes can be no greater than x ° F. per each x minutes, as an example.

FIG. 6 illustrates the same process as in FIG. 5 except that in this case the left side of the drawing illustrates a different process for resetting LWT/DLT. The center and right hand side of the drawing is not relevant of discussion of FIG. 6 and may be ignored since the only difference is on the left hand side. In FIG. 6 we see that when H>Hmax condition occurs, a calculation is performed in step S-601 to determine the condensation point of the indoor air and then using a coefficient or lookup table, a new LWT/DLT is selected based on conditions and to produce a setting based on a specific ΔT from condensation point. This approach is generally more gradual, but in extreme cases faster, and can be more efficient, that the approach outlined related to FIG. 5 as the approach of FIG. 6 may require smaller adjustments to DLT. Shown are the first change of DLT at S-601 and then after x minutes if the H>Hmax condition has cleared, a return to PID normal control. If the H>Hmax has not cleared after x minutes, the next step is to increase the ΔT by x degrees F. per step S-603. After x minutes per step S-604 the H>Hmax is resolved then the system returns to normal control but if not, resolved after x minutes, per step S-604, the system will then go to its lowest allowed DLT setting and remain there until the H>Hmax is cleared and then return to normal control. It should be noted that where illustrates 3 steps on DLT H control, there could be as many as desired in order to make the changes more granular.

Figure 15:
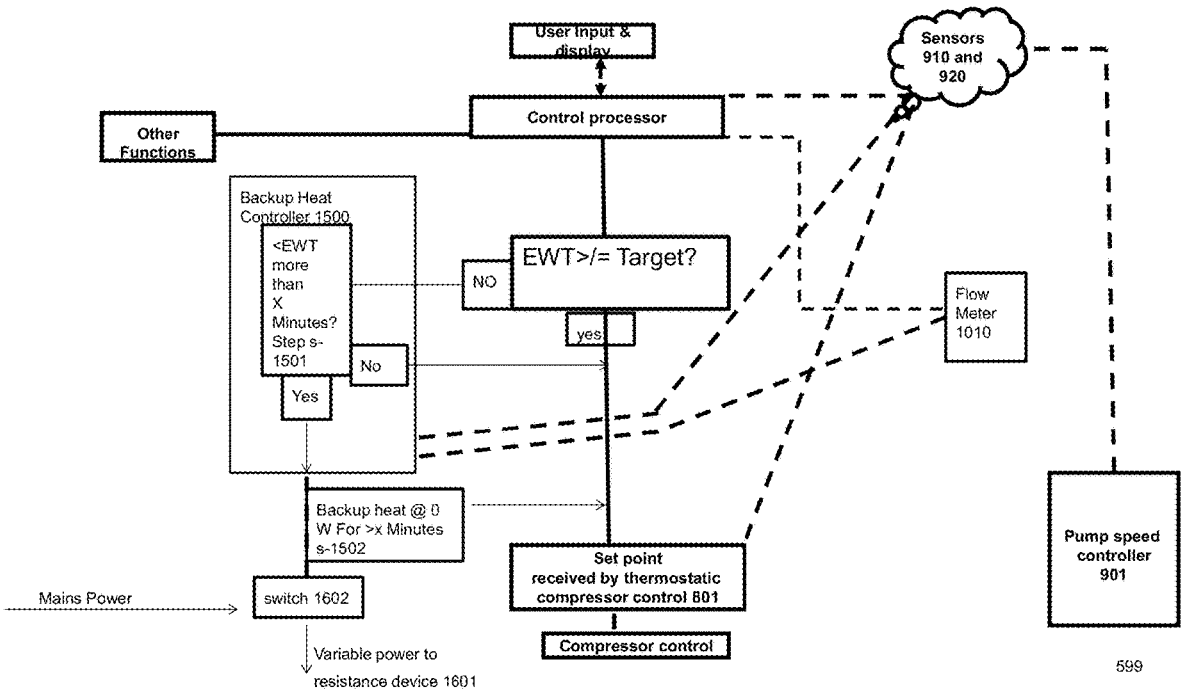
FIG. 15 illustrates an exemplary embodiment/iteration with capacity-based compressor/pump speed control in heating mode and includes variable capacity backup heat control according to the presently disclosed systems, methods, and/or apparatuses.

FIG. 15 illustrates the basic elements of the control system that are used during heating mode. Controller 1204 connects to controller 801 and each or both connect to sensors 910 and 920 for the purposes of controlling the speed of compressor 1204 to maintain the targeted LWT (leaving water temperature) or EWT. Speed of the compressor 1204 is PID controlled to match the temperature target and may be controlled with the assistance of control module 802 as previously described. As EWT changes, the compressor and pump 1205 speed is adjusted to keep EWT as close as possible to target as further explained herein. Success/failure of maintaining set point is monitored by backup heat controller 1500 through step S-1501. If set point cannot be maintained for a period of x minutes, then the system will engage backup heating. When backup heat is engaged, a BTU shortfall calculation is performed by controller 1500 using date from sensors 910 and 920 which together offer the information need to calculate the current ΔT, which along with flow rate data from flow meter 1010, allow a BTU shortfall to be quantified. For example if flow rate is at 5 GPM and the LWT shortfall is 5° F. below target, the controller 1500 knows the needed BTU (or W) of backup heat energy based on the following example calculation:

Shortfall amount in ° F.×flow rate in GPM×8.33×60×1.0/3.412=the amount of W that needs to be added to the loop to cause the temperature of the loop to rise to match the LWT target will be known.

In the 5 GPM example, BTU shortfall of 5° F. may calculated like this:

$$5° F.\times 5\times 8.33\times 60\times 1.0=12495 \text{ BTU}$$

Thus, controller 1500 knows that 12,495 BTU is the heating shortfall and is the amount of backup heat that needs to be applied. Controller 1500 will send a signal to switch 1602. In this example of 12,495 which is also the same as 3662 W, controller 1500 will signal switch 1602 so as to provide 3662 W of electrical energy from resistance heating device 1601. Once backup heat has been activated, until deactivated by a period of zero usage for x minutes by step S-1502, controller will continuously calculate shortfall and send continuing adjustments to switch 1602.

Figure 16:
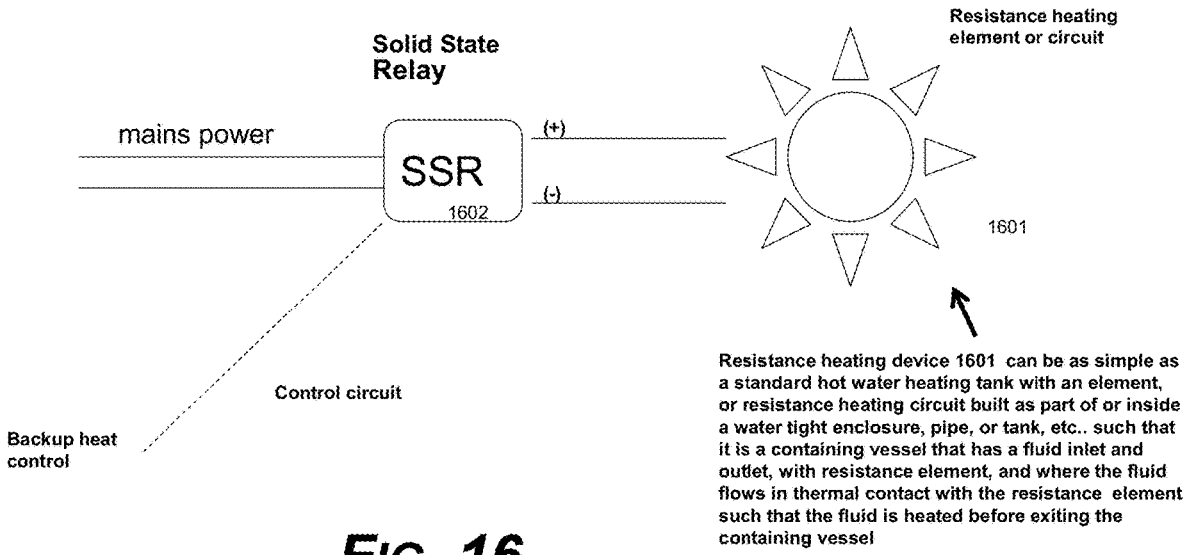
FIG. 16 illustrates an exemplary embodiment/iteration with detail of components used in capacity-based backup heat control, illustrates a solid state relay receiving control signals from the CVCC and modulating power input to vary the output of a resistance heating device.
Figure 17:
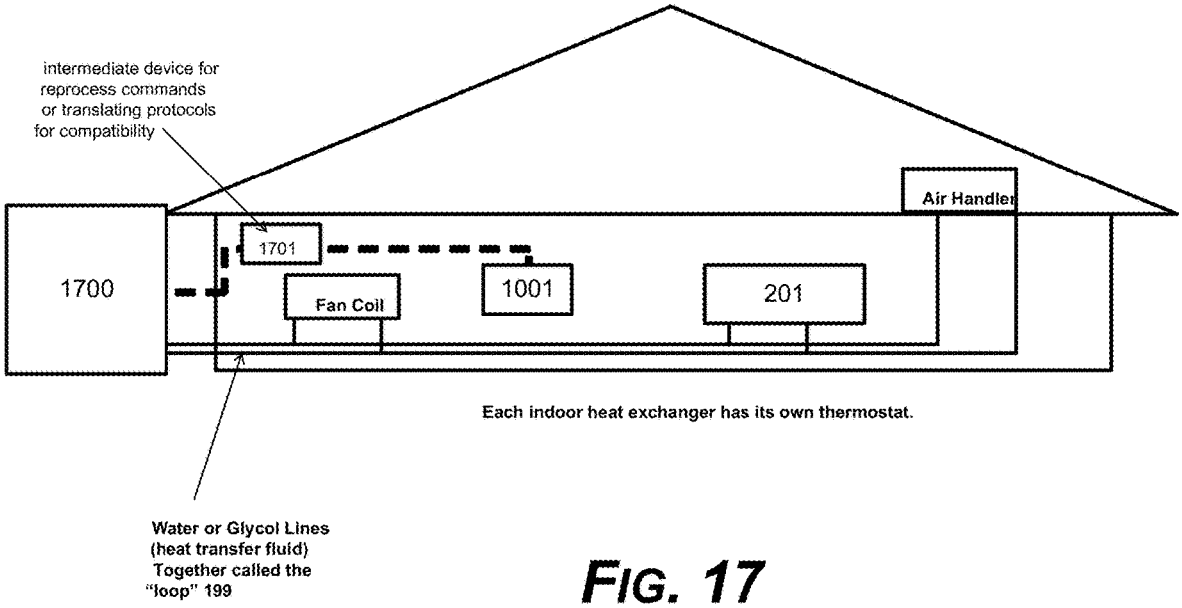
FIG. 17 illustrates an exemplary embodiment/iteration showing how the CVCC controls system used with heat pump including controller could be used with any brand or type of variable speed chiller or hydronic heat pump system.

FIG. 16 explains more about the connection and operation of switch 1602 and resistance element 1601. In FIG. 16 illustrates switch 1602 to be a solid state relay (SSR). In practice this could alternatively be a SCR or a relay that could control either total W delivered or voltage, or limit amps, or modify the phase angle of the power. In this example illustrates the SSR which modifies the voltage by phase angle control. So assuming 220 v mains power and a 6000 w resistance heating element 1601, when 100% of the 220 v power is applied the heating element 1601 it will produce 6000 w of power (20,472 BTU). However, in the SSR example if we modify the voltage sent to the element 1601 such that the voltage is lower, then the W output will also be lower. For example a calculation can be made to determine the input voltage of the resistance element needed to produce the desired output watts of heat from element 1601 can be known by controller 1500 by using a lookup table or based on a calculation such as the following example where output W=(Wr×v^2)/V^2, where W is the required output watts, Wr is the resistance element rated wattage, V is the applied voltage and Vr is the element rated voltage. In the case of a 6000 w element rated at 220 v, 3662 w output may be obtained by causing the SSR to provide ~172 v to the heating element. The controller would signal the SSR so as to target that voltage.

Figure 7:
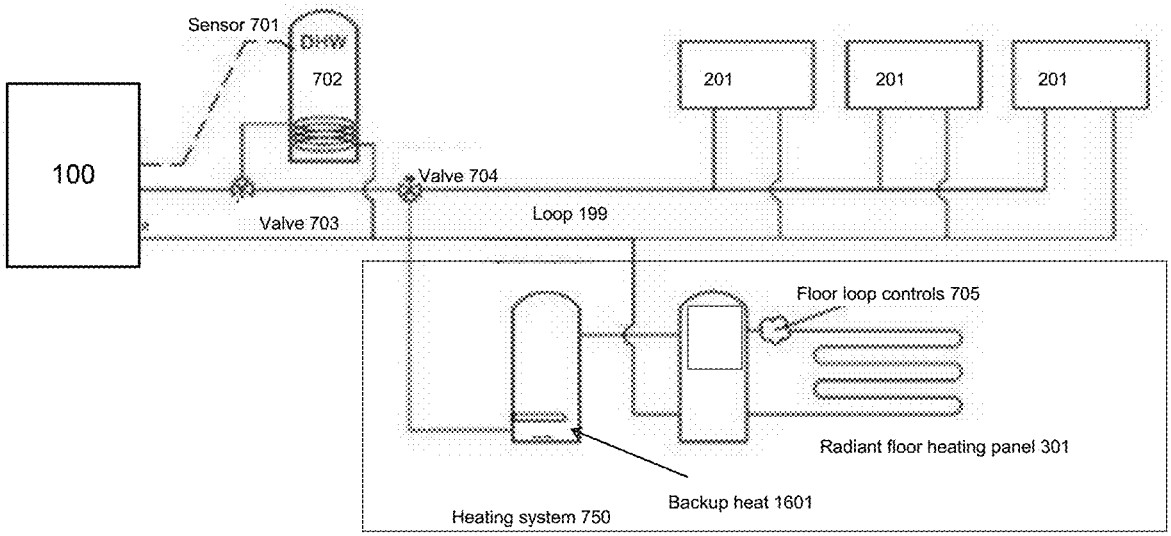
FIG. 7 illustrates an exemplary embodiment/iteration of CVCC system with controller basic capacity controls and illustrates automatic loop valve control for controlling an additional sub-loop or heat exchanger tank.

FIG. 7 illustrates an example of automatic valve control as performed by chiller 100. In this example, heated fluid from chiller 100 is pumped through the coils of heat exchanger tank 702 to heat a second fluid of heat exchanger tank 702. "Heat exchanger tank" is a tank with an internal coil such that a hotter or colder fluid passing through the coil can heat or cool the contents of the tank. The tank 702 is labeled as a DHW type because that is a common use for this type of tank but it should be noted that heat exchanger tank 702 can be used for heating or cooling of any fluid. Sensor 701 is a sensor for DHW (Domestic Water Heater) heat exchanger tank 702 and lets chiller 100 know that the tank 702 needs heat (or cooling, in certain iterations). When DHW or another application such as cooling) is activated, three-way valve 703 changes position and chiller 100 goes into the appropriate heating or cooling mode at high speed to heat or cool tank 702. When tank 702 temperature sensor 701 is satisfied, valve 703 switches back to normal position and the system may resume its previous mode, either heating or cooling, or possibly stand-by. Note, the "DHW" tank 702 and valve 703 and sensor 701 could be used with chiller 100 for any application where tank 702 may be used to either chill or heat a second fluid which may be water but may be another fluid within the heat exchanger tank 702, such fluid could be heated or cooled to a different temperature than is targeted for loop 199. Tank 702 and valve 703 and sensor 701 may also be operated with chiller 100 when loop 199 is not in use.

Valve 704 is designed to isolate heating system 750 from the loop 199 during cooling mode and may also isolate fan coil units 201 from loop 199 during heating mode. Backup heat 1601 is shown in this example as a tank with resistance element 1601 inside and is shown for reference only. Fan coil units 201 are shown for reference only. Floor loop is shown as radiant panel 301 and controlled by floor loop control 705. During cooling mode of chiller 100, valve 704 may allow loop 199 fluid to flow to fan coil units 201 for cooling operation, but not allow flow to the heating system 750 comprising backup heat 1601 and radiant panel 301 or floor loop controls 705. In heating mode, valve 704 may disallow loop 199 flow to fan coils 201 and only allow flow to heating system 750 comprising backup heat 1601 and radiant panel 301 or floor loop controls 705.

It should be again noted that the valve control and goals of system may not be limited to DHW (domestic water heating). The idea of having a tank 702 or loop section that can operate at a different temperature from the main section or other sections has the stated goals in the case of heating domestic hot water using a heat exchanger tank 702 but other applications may exist, for example, with cold water, where, for example, colder fluid may be needed in a section of the system for handling a specific load type such as a dedicated dehumidification system, process cooling, etc. Likewise, a warmer temperature may be needed in a section of a cooling section to serve a load such as a radiant panel 301 where, when used for cooling, latent heat rejection must be avoided, etc. In heating mode, aside from DHW, this approach may allow for, as an example, providing heated fluid to a loop section serving fan coils 201 or air handler 102 may to be warmer than a loop section serving radiant panels 301.

In any case, a typical chiller or heat pump system that needs to provide 2 or more different temperatures in the loop(s) section (including any tanks) would target, in the case of heating, the higher temperature and then use a mixing or tempering valve to produce a second lower temperature for another section of the system, as needed. Likewise, in the case of cooling, a typical system would target the coldest value needed by any loop(s) or tank(s) or section of the system and then use a mixing valve to produce a second warmer temperature for a different section requirement. Neither of these approaches will produce the highest Carnot efficiency, therefore the CVCC system is designed to allow chiller 100 output to control to valve 703 to switch between 2 or more loop sections and dynamically re-target the LWT or EWT temperature setting directly to the requirement of each section by switching between sections as determined by chiller 100 control system.

It being obvious from prior FIGS. and detailed description that the control system of the CVCC, including controller 110, has the ability to, based on input from environmental sensors and internal calculations, send dynamically changing EWT and/or LWT targets to chiller 100 for execution along with its other described capabilities.

However, in the exemplary embodiment/iteration of the controls system described previously herein including controller 110 could also function independently as a hardware and software control system 1703 and connect, through an intermediate device 1701, if needed to reprocess commands or translate protocols to achieve communications capability, to any known or generic heat pump equipped with a variable speed compressor where such control means could perform the tasks of sending control information to a heat pump 1700 for the purposes of dynamically controlling the EWT or LWT settings of such system so as to manage dynamic loop temperature changes so as to control latent heat removal and/or to more accurately control capacity matching, and/or to apply other previously described control functions of the heat pump control system to a heat pump 1700 to positively affect the operation or efficiency of such hydronic heat pump.

Figure 18:
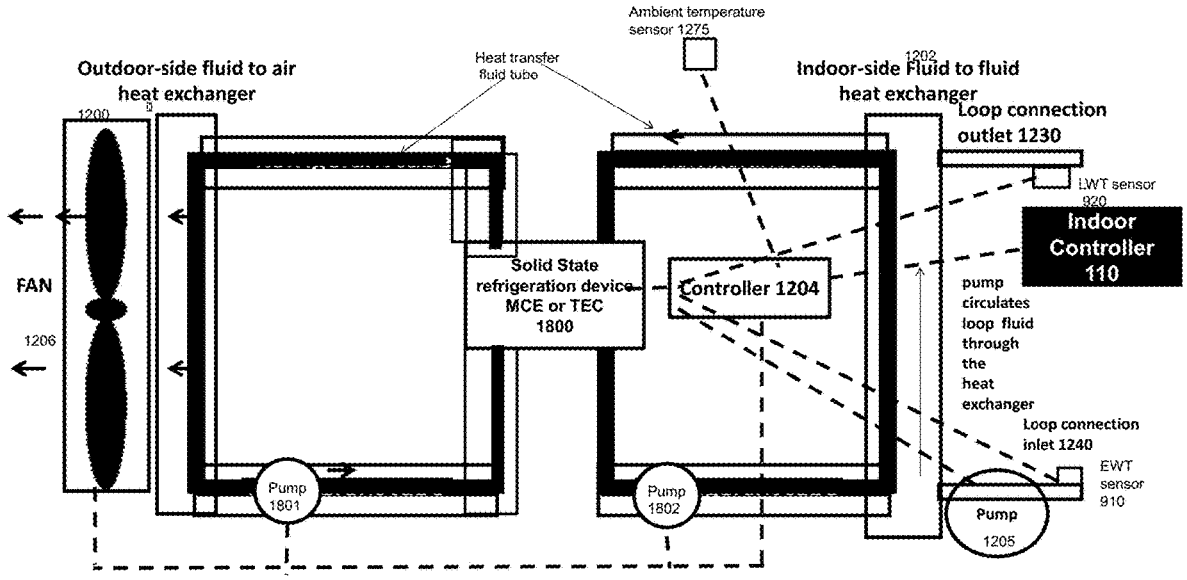
FIG. 18 illustrates an exemplary embodiment/iteration showing how a solid state refrigeration device such as A TEC or MCE (magnetocaloric) refrigeration device may be used instead of a compressor, refrigerant, and other components.

FIG. 18 illustrates how a solid state refrigeration device 1800 such as a magnetocaloric refrigeration device such as are now available in the market, or a thermoelectric device such as a high efficiency Peltier or TEG, either type having a "hot side" and a "cold side", which may be reversible for either cooling or heating, and either could be used in the place of certain previously identified components of chiller 100 shown in FIG. 12 such as expansion valve 1203, and compressor 1201, and where indoor-side heat exchanger 1202 could instead be of the fluid-to-fluid type and the outdoor-side heat exchanger 1200 could instead be of the fluid-to-fluid type or fluid-to-air type and where the refrigerant may be replaced with water or other heat transfer fluid.

In the case of using a solid state refrigeration device 1800 thusly, the modulation or control of such solid state refrigeration device 1800 would be handled in the same manner as previously described for chiller 100 capacity control based on matching a set point value at either sensor 920 or sensor 910, and where the cooling or heating capacity of such device is modulated with capacity being matched to the load, based on matching a target entering or leaving fluid temperature of the indoor-side heat exchanger, and pump 1205 may be controlled based on the $\Delta T$ between the target entering and leaving fluid temperature of the indoor-side heat exchanger.

Pumps 1801 are controlled by controller 1204. Further, as with chiller 100, the target EWT or LWT may be adjusted upwards or downwards based on controller 110 output in accordance with psychrometric goals as previously explained where loop 199 temperature and latent heat removal is controlled by controller 110 based on environmental sensor inputs.

The solid state refrigeration device 1800 is not the object of, but simply a component of, the CVCC system when using such solid state device. This device type may have a hot side and a cold side, such sides may be reversible. In FIG. 18 we see heat taken away from the hot side and added to the cold side via heat transfer fluid tubes and through the indoor-side 1202 and outdoor side 1200 heat exchangers.

Figure 19:
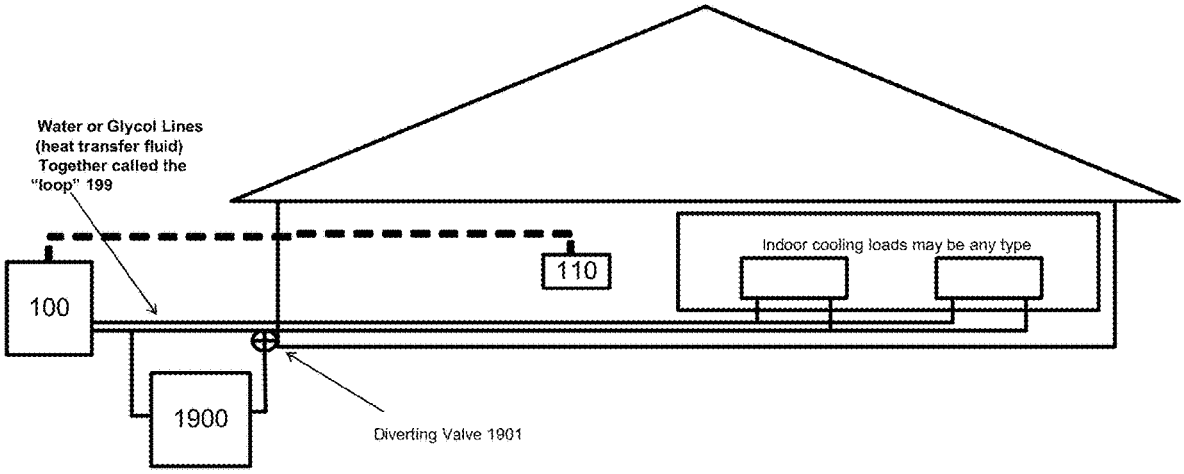
FIG. 19 illustrates an exemplary embodiment/iteration showing how a "free cooling" fan coil unit may attach to and become part of the CVCC system.

The CVCC system of FIG. 19 is an exemplary embodiment/iteration of the same systems as shown previously with a loop 199 connecting fan coils or other indoor heat exchangers to chiller 100, with the difference being that on the return side of loop 199, a diverting valve 1901 and free-cooling unit fluid-to-air fan coil 1900 may be added.

The fluid to air fan coil 1900 may be in series with loop 199 or may be in a bypass configuration as shown, where under certain conditions chiller 100 controls will operate a valve 1901 to divert heat transfer fluid in loop 199 so as to transit the fluid-to-fluid fan coil 1900 before entering chiller 100. Such controls of chiller 100 may also operate the fan of fan coil 1900.

This free cooling system may be used in cases where indoor cooling requirements are persistent year round such as in the example of cooling electronics or computer servers, a kitchen, or a process requiring cooling etc. in the winter or other times when outdoor temperatures are low enough to be beneficial. When activated, "free cooling" operation mode is established whereby fluid in loop 199, having already absorbed heat from indoor cooling loads, may be intercepted at valve 1901 before returning to inlet of chiller 100 and diverted through the fluid-to-air fan coil 1900 for cooling or pre-cooling of the fluid before entering chiller 100 inlet.

The fan speed of the fluid-to-fluid fan coil unit may be further adjusted by CVCC controls and sensors to target a specific temperature of fluid leaving the fluid-to-fluid fan coil 1900. The fluid-to-fluid fan coil 1900 outlet temperature being equal to chiller 100 entering fluid temperature and in cases where the compressor 1201 is off, the same as the chiller 100 LWT. Thus the fan speed of free cooling unit 1900 controls the amount of cooling performed on the fluid and will attempt to match the fluid temperature exiting fan coil 1900 to the chiller 100 LWT set point when possible. When not possible, compressor 1201 will operate to make up any shortfall of cooling.

When chiller 100 receives cooled or pre-cooled fluid the compressor 1201 may be allowed to run slower than if the fluid were not pre-cooled and in some cases the entering temperature of chiller 100 may be low enough that compressor 1201 may not need to operate at all.

As an example, a "free cooling" mode may be activated when outdoor temperatures are below 38° F., and when outdoor temperatures are below 28° F. the compressor may not need to operate in order for chiller 100 to deliver the temperature and/or BTU capacity requirements to match the indoor cooling load thus saving energy.

Figure 20:
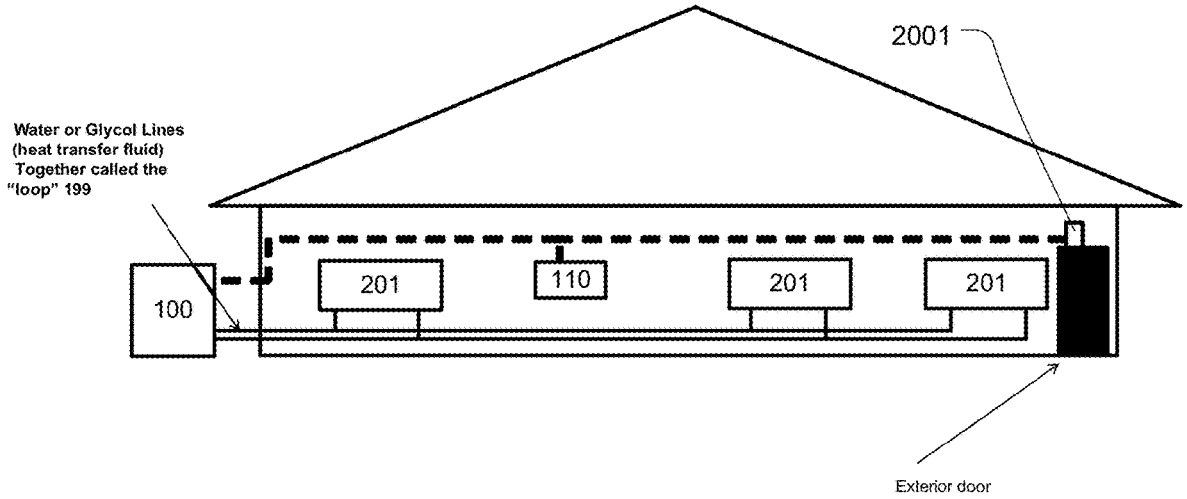
FIG. 20 illustrates an exemplary embodiment/iteration of the CVCC system as shown previously where additional sensors may be used and new features provided.

FIG. 20 illustrates an exemplary embodiment/iteration of the CVCC system as shown previously where additional sensors may be used and new features provided.

In this a process, controller 110 may be connected to additional sensors such that the system can anticipate or foresee an increase or decrease in either cooling or heating load and cause chiller 100 to take temporary action based on a predicted increase or decrease in cooling or heating load.

For example, the controls, considering the ΔT between an outdoor ambient sensor 1275 and indoor air temperature sensor such as environmental sensor 1301, and further connected to a sensor 2001 indicating a door has opened between the conditioned space and the outdoors, such sensor may also report the duration of the door opening, and thus may inform chiller 100 control system including controller 110 or controller 1204 that a cooling or heating load is likely to increase or decrease in the near term. In the case of such event, chiller 100 controls may override existing control programming to, for example, arbitrarily increase compressor speed by a certain percentage for a certain time and await results before returning to its regular programming.

In addition to a door opening sensor 2001, such additional sensors could include motion detectors, infrared sensors, a sensor showing increased or decreased internal load such as additional indoor electrical equipment powering up, or down, etc. and the scope of the types of sensors used or purposes used for, is limited only to the things that can be thought up by a practitioner skilled in the art as a means of giving chiller 100 a head start on meeting a new or increased load, or to prepare for a decrease of load.

The CVCC is an improved chiller or hydronic heat pump and controls means consisting of at least one or more each of a chiller 100 each comprising at least one compressor 1201, at least indoor-side heat exchanger 1202, at least one outdoor-side heat exchanger 1200, one or more metering device 1203, and a system controller 1204, whereby the outdoor-side heat exchanger may be either air-to-refrigerant or water-to-refrigerant and where the indoor-side heat exchanger is of the refrigerant-to fluid type and where the system is designed to heat or cool a heat transfer fluid in a loop 199 such as water or other heat transfer fluid in further communication with indoor heat exchanger(s) (see 102, 201, 301 as non-limiting examples) which are associated with but not necessarily a part of the CVCC, said indoor heat exchanger(s) are connected to the indoor-side heat exchanger 1202 by the loop 199. The loop 199 consists of piping or tubing containing a heat transfer fluid that may be water, a water-glycol mix, or other heat transfer fluid—for purposes of examples we may describe it as water. The loop 199 may have tanks and/or valves, booster pumps, etc. in-line at various points which are not shown that could be added by a user or installer as needed. The indoor-side heat exchanger 1202 may be physically inside the chiller 100 as shown or may be "extended" to a location outside of the outdoor unit enclosure, potentially indoors, and connected to the outdoor equipment by refrigerant lines. The outdoor-side heat exchanger 1200 may be an air-to refrigerant exchanger as shown or could be a water-to-refrigerant exchanger, or a hybrid or combination of both types where the controller 1204 can select which exchanger to use based on the more advantageous temperature of either air or water, and in the case where there is a refrigerant-to-water such as 1200 outdoor-side exchanger used, the controller 1204 can manage any valves needed for switching between outdoor-side heat exchangers, and/or manage water pump control associated with an outdoor-side refrigerant-to-water exchanger.

The improved chiller or chiller system (CVCC) (generically referred to as a chiller) chiller 100 uses a variable speed compressor 1201 and one or more variable speed circulating pumps 1205, variable speed or multi-speed fan 1206, and continuously variable parameters that are dynamically controlled based on sensor inputs and psychrometric goals to manage the settings of flow rate, BTU values, and the LWT (Leaving water temperature) and EWT (entering water temperature) of the indoor-side heat exchanger 1202 as it enters the supply side of the distribution loop 199 at outlet 1230 or as it returns to the chiller 100 from loop 199 through inlet 1240. As conditions change, the speeds of compressor, fan, pump also changes. The particular technology used for operating the variable speed functionality is not relevant provided that the pump 1205 and compressor 1201 are variable speed and can be speed controlled by the system. Variable speed pumps can be purchased or configured to operate with an internal or external control device. Many variable speed compressors can be ordered with a manufacturer-provided IPM board or custom IPM board, and temperature-based thermostatic compressor speed controls can be customized or purchased on the open market. The speed controls such as pump controller 901 may include PID or other feedback control. Controller 1204 along with controllers 801 and 802 may be used to adjust the compressor 1201 speed to produce a certain amount of BTU or LWT (leaving water temperature) or target a specific EWT (entering water temperature) and/or a certain ΔT. It should be understood that a change to either LWT or EWT may be essentially the same thing in a system where a specific ΔT between EWT and LWT is targeted. In some cases we refer to sensing or changing "loop temperature", it should be understood that this term may refer to any of LWT or EWT. DLT (dynamic loop temperature) simply means a temperature that has been changed dynamically.

In cooling mode with a ΔT target of 10° F., the EWT sensor 910 would targeted to be 10° F. warmer than the targeted LWT sensor 920. In heating mode the EWT would be targeted to be 10° F. cooler that LWT. For example, if the ΔT target is set to be 10° F., in cooling mode a change of EWT target to 50° F. would be the same thing as a targeting change of LWT to 40° F. Likewise a change of LWT to 45° F. would be essentially the same as a change of EWT target to 55° F. The reverse of this applies to heating mode, where, with a ΔT target of 10° F., a target of LWT 100° F. would be the same as a EWT target of 90° F. The CVCC system may use either EWT or LWT for purposes of loop temperature control. Where we refer to changing EWT or LWT targets it should be understood that where we discuss changing one we are seeking to accomplish the same effect as if changing the other, and the CVCC system can operated either way.

The system may be controlled at a higher level by an indoor controller 110 with sensors, user inputs at controllers 110 (using touch screen display 1101) or 1204, and, providing inputs to one or more control modules that may include the main controller 1204, or may also provide inputs directly to compressor controller 801, pump controller 901, and to other control modules for various components.

In the CVCC indoor controller 110, environmental sensors such as sensible temperature sensors, hygrometers and/or humidity sensors such as sensor 1301 connect to indoor control unit 110, which further connects to equipment in the controls and/or components in the chiller 100, comprising a control system. The control system, based on user settings and parameters, and sensor data received, can signal the operational parameters of the chiller 100 as well as signal set point changes affecting the system components directly or through control modules for controlling compressor speed and/or the fan 1206 speed, pump 1205 speed, etc. In certain iterations, the control system may be a unified control mechanism whereby all control is managed from an indoor controller 110 or may be distributed across multiple control modules, any or all of which may use an algorithm with a feedback mechanism or other means for managing system parameters, PWM, inverter frequency, or other control.

It should be noted that the CVCC can function without the indoor controller 110. In that case, capacity controls such as pump speed, compressor speed, capacity, etc. would function based on capacity control as described herein however certain controls would behave based on default settings or manual setting inputs rather than dynamic input. Specifically, without indoor controller 110 installed, the EWT and LWT would not dynamically change based on indoor conditions and the controller 1204 would continue to manage the variable speed compressor 1201, pump 1205, and fan 1206, all of which would continue to operate on the basis of controlling capacity to match the indoor heating or cooling load by targeting a specific EWT/LWT and targeting a specific ΔT between EWT of sensor 910 and LWT of sensor 920.

The CVCC chiller with indoor controller 110 is designed to further provide enough dehumidification to meet requirements without over-dehumidification, or waste of energy. The CVCC chiller is therefore continuously making adjustments to parameters such as LWT to meet conditions and requirements. This means that the set points for 1201 compressor speed, 1206 fan speed, 1205 pump speed, and LWT (leaving water temperature) and/or EWT (entering water temperature) may be continuously changing. For example, when indoor humidity is high the chiller 100 LWT (Leaving Water Temperature) and/or EWT (entering water temperature) can be adjusted downwards by controller 110 signals to other controllers or components to provide lower loop 199 temperatures and therefore higher dehumidification. Further, if the indoor controller senses that the indoor heat exchangers (102, 201, 301) are not meeting the load due to insufficient capacity (assumed to be caused by not enough ΔT between the cooling coil and the indoor air) and the CVCC has available additional capacity (not running at full speed), the indoor controller will signal for a change to a lower EWT/LWT. When adverse conditions abate, the EWT/LWT targets would be re-adjusted upwards (in the case of cooling mode) to reduce or stop latent heat removal and return the chiller 100 to a more efficient operating state.

The CVCC continuously variable chiller & control system has the ability to actively, continuously and automatically manage the chillers parameters resulting in a dynamically variable target LWT, EWT, compressor speed, pump speed, etc. The controls used for this are such that the system can measure the indoor conditions and respond accordingly. In an exemplary embodiment/iteration of this feature, in cooling mode, the system controller 110, using input from a sensor(s) 1301, may determine that humidity or temperature is above or trending towards rising above a max default or user defined set point or in the case of temperature, to a point such that the indoor equipment cannot handle the sensible load at the current LWT. In the example of temperature increase, the controller 110 would lower the LWT target to a reduced temperature and watch for positive results to the condition.

In certain exemplary embodiments/iterations, the chiller 100 will simply lower the temperature until feedback response matches the set points such as is illustrated in FIG. 5. If after a given time the response of conditions or trend is not satisfactory, the LWT can be further lowered. After the initial or subsequent LWT change produces satisfactory results, the controller can slowly raise the LWT. When conditions or trending are such that warmer LWT conditions can be allowed, the indoor controller will allow the LWT to rise to the highest setting possible that does not allow a negative set of conditions to occur. For example, both H and T are monitored. In the case of H exceeding maxH, the DLT would be lowered first the default setting and if H>MaxH is not resolved within x minutes, the loop temperature would change to the lowest possible value. While illustrates a 2-step or 3-step process for resolving H>maxH or T>MaxT in certain FIGS., it should be understood that there could be a larger or much larger number of smaller steps. Likewise if indoor temperature rises above MaxT then the controls will lower the DLT to a default setting. If after x minutes T is still >MaxT then the DLT will be lowered to the lowest setting allowed. At any time when DLT changes have resolved wither a MaxH or MaxT condition, the system will try again to raise the DLT to a more efficient setting but will use dampening logic to control the rate of DLT change. Since the system is capacity controlled based on ΔT between EWT and LWT, a sudden change during recovery to a warmer set point could cause the ΔT to skew in a way that could indicate a sharply reduced load when no sharp load reduction is present, therefore dampening logic prevents the DLT from rising too fast. Dampening logic can be based on a timer or based on not allowing an upwards DLT change to be a setting that exceeds actual EWT by more than x degrees F.

In another exemplary embodiment/iteration, in the case of humidity, the controller 110 can, in certain exemplary embodiments/iterations consider the indoor condensation point and adjust the LWT or EWT to a lower temperature to a point such as to cause an increase in latent heat removal when such loop 199 temperature set point is calculated based on a delta to condensation point rather than using a pre-set default. For example, if H>MaxH, a downward loop temperature change would occur, the new target temperature could be an initial value such as the indoor condensation point temperature minus x degrees as the result of program code or lookup tables. If after x minutes the H>maxH condition is not resolved the loop temperature could be further lowered to a new value with a higher delta T between condensation point and LWT, further increasing latent heat removal. If after some further x time of this, H>maxH persists, the system can further lower the loop temperature to its lowest possible temperature.

In certain exemplary embodiments/iterations, the frequency (speed) of the compressor is controlled by a compressor control board 801 provided by the compressor manufacturer or from an aftermarket source, that modulates the compressor 1201 speed based on approaching and satisfying a temperature set point of sensor 920 or 910 such that as the error from set point narrows as the compressor speed is reduced and the controls will try to match compressor speed to the load and avoid on/off cycling, typically using a PID or other feedback control. In this case, the CVCC controls would provide inputs to the compressor control that cause changes to compressor speed. The compressor speed is adjusted by the compressor control to attempt to maintain a LWT equal to the target set point based on signals from controller 1204 and/or controller 110. Alternatively, the compressor control 801 may set the speed based on coefficients or lookup tables from control module 802 where known BTU values have been tabulated and associated with each level of compressor speed, various ambient and loop temperature conditions, and flow rates. Likewise, one or more coefficients can be used, based on the same information.

The PID or feedback control of controller 110 is programmed to maintain a LWT or EWT such that the indoor thermostat controlled equipment such as fan coils, are capable of managing temperature within its set point as reflected by comparing indoor maximum user defined set point to actual indoor temperature. The PID or feedback control of controller 110 may signal controller 1204 so as to operate the loop at a temperature no lower than is needed to accomplish this goal unless it is overridden by external control needed to increase dehumidification.

Control of the pump speed could be handled by main controller 1204 based on lookup tables and/or input from controller 110 but pump speed is generally handled independently by pump controller 901 such that the pump speed is adjusted up or down in a differential manner as ΔT rises or falls, to keep the ΔT near to the ΔT set point. The pump controls 901 can be set to maintain a specific ΔT between EWT and LWT by reading sensor output of sensor 910 and 920. Combining the variable speed pump targeting the ΔT and a variable speed compressor targeting the LWT or EWT set point, the system capacity will always be approximately equal to the load, as shown in the following example where pump control ΔT is set to be 10° F.

The BTU capacity of the compressor, for a given set of conditions, is directly related to the frequency (speed) of the compressor. BTU output of the system is equal to the following formula: Water flow in GPM×the ΔT (temperature difference between EWT and LWT) multiplied by the weight in lbs. of water per gallon (8.33), multiplied by the specific heat of the fluid (for pure water, 1.0, adjustable for other fluids), multiplied by 60 (minutes per hour). In the following cooling examples, we will use 10° F. ΔT for pump ΔT control set point. In other examples we may refer to the formula as BTU=500×ΔT×GPM, where 500 is equal (close enough) to 8.33×60×1.0) (499.98)

By targeting a ΔT of 10° F., and running the compressor 1201 at a speed such that the LWT (or EWT-10° F.) is the set point target, capacity is always matched to the cooling load. Of course, the capacity controls scenario may also be used in heating mode, with the difference being a target of EWT+10 as an example.

Example of relationship between BTU and water flow rate and ΔT:

$$BTU=GPM\times\Delta T(^\circ F.)\times 8.33\times 1.0\times 60$$

Therefore, 2.4 GPM×10ΔT×8.33×1×60=11,999 BTU

The control responds to a change in load dynamically. For example, in cooling mode, the controller can see a decrease in EWT indicating a reduction of cooling load and adjust to it in real time. As an example of this, a system running as BTU load of 8.33×1.0×10×2.4×60, or 11,999 BTU, would see any increase or decrease in return water temperature, in the case of a decrease of ΔT, it would indicate a reduction of cooling load. As an example, when the cooling load decreases, the return water will be cooler than the 10° F. ΔT would indicate at the previous load, for example we may see water return 5° F. (Δ5) cooler due to a reduction in load and in this case the system would know the new load condition is as follows:

$$BTU\ load=8.33\times 1.0\times 5\times 2.4\times 60=6{,}000\ BTU$$

In this case the control system may immediately respond to the new load conditions by lowering the speed of the compressor 1201 to maintain the set LWT (EWT-10° F.) and by lowering the speed of the pump 1205 to enforce the 10° F. ΔT, such that the following conditions will result $$BTU\ load=8.33\times 1.0\times 10\times 1.2\times 60=6{,}000\ BTU$$

Likewise an increase in cooling load could be seen in the following example where a system running at 12000 BTU sees an increase in load whereby ΔT increases to 14° F.:

$$BTU\ load=8.33\times 60\times 1.0\times 14\times 2.4=16{,}793\ BTU$$

In this case the controls would adjust the compressor 1201 speed to maintain the set LWT, and modulate the pump 1205 flow rate so as to return back to ΔT of 10 and reach the following set of conditions:

$$8.33\times 1.0\times 10\times 3.35\times 60=16{,}793\ BTU$$

PID temperature control or other feedback control may be used in controller 110 and other controllers. PID and/or feedback control is a well understood art is no further explanation should be needed. In the control system, the use of PID or other feedback control may be also be used by controller 901 to manage ΔT (pump control) and/or for LWT/EWT targeting (compressor speed) by controller 1204 or compressor controller 801. When EWT or LWT is not at default because it has been dynamically changed by controller 110, it may also be referred to as DLT (dynamic loop temperature).

We will also see that controller 110 may override the dynamic loop calculations with conditional statements further managing humidity where external logic overrides the PID such as seen in FIG. 5, steps S-503, S-504, S-505, and S-506, and FIG. 6 in steps S-601, S-602, S-603, S-604 etc. These override controls are shown based on conditional statements but could also be managed by a 2nd PID, Fuzzy Logic, etc. In the example below, illustrates this with conditional statements.

In FIG. 5 we see that when H is <MaxH then no action is needed and PID has control. If H>MaxH then the system will drop to its default temperature. If after X minutes, H is still >MaxH, DLT will be lowered to lowest allowed loop set point. After H has been satisfied and is <MaxH, DLT control is returned to PID. In plain English according to this example: PID controls DLT unless H>Hmax in which case control is given to a set of conditional statements.

Likewise, we see in FIG. 6 that as to resolving a >MaxH condition, a condensation point calculation can be made as a part of this process. In this example, the control system calculates the condensation point based on hygrometer and temperature input or from temperature and RH input from sensor 1301. Then the initial step would be to lower the DLT to a calculated set point (or from a lookup table) of x ° F. below the condensation point. If further action is needed after x minutes, a higher ΔT from condensation point can be used up to the point of reaching lowest allowed minimum DLT (lowest allowed LWT). The rate of dehumidification is dependent on the negative ΔT between condensation point of the indoor air and the loop temperature (LWT) where the larger the ΔT, the greater the action of latent heat removal (dehumidification) will be. For example, if indoor CP (condensation point) is 60° F. and LWT is 60° F. or above then no dehumidification would occur, if indoor CP is 60° F. and LWT is 50° F. then moderate dehumidification will occur, if indoor DP (condensation point) is 60° F. and LWT is 40° F. then very strong dehumidification would occur.

We also see in FIGS. 5, 6 that DLT dampening logic S-511 is used, this promotes a gradual recovery of DLT to a higher set point after H and/or T is back below the acceptable upper limit. DLT Dampening Logic is employed to prevent unnecessary compressor slowdown or shutdown. A timer or other limiting means is used to limit the rate of compressor speed change caused by PID output for DLT change when recovering control back to PID such that the compressor speed will change at a more gradual rate to avoid compressor thermostatic shutdown. Upon release back to PID control the controller, dampening logic may restrict the rate of change based on timing or other overriding limit.

For example, if H has exceed MaxH and DLT has been invoked, after H>MaxH has been resolved, the system will restrict the rate that LWT temperature can be increased while recovering back to a higher LWT PID generated set point. Dampening logic can suppress or delay PID output. If DLT is increased too rapidly, because of the decreased ΔT between LWT and EWT that would result, the system capacity control functions could assume that the total cooling load has suddenly deceased when it has not changed much if at all. Therefore in the case of recovering DLT to a warmer more efficient temperature, the rate of DLT change can be limited. In certain exemplary embodiments/iterations, the controller dampening logic may override the PID output before sending final output to the compressor control, such that the DLT EWT is not raised by more than x ° F. above the actual returning/entering water temperature (EWT). Therefore, recovery to a higher LWT is done in increments allowing the EWT increases to stay within the hysteresis range of the controls to prevent compressor shutdown.

In an exemplary, nonlimiting embodiment, the control system serves as a dynamically variable system controller for the chiller with dynamic capacity control and dynamic temperature control for managing temperature and humidity, and based on sensor input and/or user input, to manage the various functions, operation, and parameter changes of the chiller 100. The control system consists of an indoor control device 110 with user inputs which may, in addition to its control functions, also contain a digital display for displaying system status, temperature, and psychrometric data, said digital display data being derived from sensor data provided by sensor 1301 or one or more each of temperature and humidity sensors remotely located within the home or office and connected to controller 110, and utilizing the process of receiving temperature and humidity data from one or more sensors, for display purposes, plot the intersection of temperature and one or more additional psychrometric measurement as a position on a digitally displayed standard psychrometric chart.

The controller 110 is also able to send control information to the chiller 100 or other control modules for the purpose of changing the operating parameters for one or more of LWT or EWT set point, compressor frequency, fan speed, pump speed, pump ΔT settings, valve positions, or make other parameter changes or adjustments needed for the operation of the chiller 100. The controller can send signals for such control in response to input from a user or from sensor input-based calculations made based on a variance from a psychrometric set point or from changes to sensor data of temperature, humidity, condensation point or other psychrometric data. The controller display may contain a factory-defined recommended zone defined by any two or more boundaries of temperature, humidity, relative humidity, wet bulb, condensation point, absolute humidity, said boundaries may be pre-configured as a region on the chart display. The controller 110, through the display 1101 and/or by data export, may also offer real time, historical, or averages, of one or more of the following: temperature, humidity, condensation point, enthalpy, absolute humidity, wet bulb, BTU, COP, EER, Compressor Frequency, power utilization, GPM, EWT, LWT, fan speed, pump speed or any other data collected during the operation of the chiller 100.

The controller 110 may be accessible for input, monitoring, management, or software updating, through a wired or wireless connection, computer network, by other devices such as phones, tablets, PCs, or internet connected devices. The controller 110 or controller 1204 may also be configured such that it can accept input from $3^{rd}$ party controls, for example, a signal to switch from heating or cooling from its current state. Such external control signal may come from any type source such or in any protocol such as MODBUS, BACNET, IP, USB, O/B switch, a simple opening or closure of a relay or contacts, etc. or from a user or automated external control through an internet connection.

The chiller system generally connects to indoor heat exchangers, these are usually fan-coil units 201 that are mounted in individual rooms, or fan coils installed in a duct system 102 but may also be a radiant type panel(s) 301 or other thermal loads such a radiant floor loop or a heat rejection device or exchanger such as may be used for a process that requires cooling. The indoor equipment can be typical hydronic indoor equipment used in the industry, in the case of a fan-coil 201, using variable speed or multi-speed fan motors. The capacity of such indoor unit is affected by the loop temperature and exchanger surface area and in the case of a fan coil unit, also by fan speed (CFM). For use with the continuously variable chiller 100, the indoor heat exchangers specified must be have a larger coil or panel than is typical for a similar rated capacity so that they can effectively cool when the loop temperature is warmer (in cooling mode) or cooler (in heating mode) than the typical loop temperature that such equipment may be designed for. In the case of a fan coil, a higher fan speed may be used when the loop is warmer to achieve the same cooling effect as would a larger fan coil with a lower fan speed, or achieve the same cooling effect as the same size fan coil would with lower (in the case of cooling mode) loop temperature. For example, a fan coil unit rated at 12000 BTU with 400 CFM at 44° F. loop temperature may only be able to produce 9000 BTU cooling when loop temperature is at 54° F. at the same CFM. However, an increase in fan speed to 600 CFM may restore the 12000 BTU capacity with the warmer loop temperature. A larger coil face on the unit could accomplish the same effect.

Fan coil equipment selected for use with the CVCC is often sized larger than usual for a given BTU loading so that the fan coil can deliver sensible cooling or heating needed at non-standard and more efficient loop temperatures such as used at times by the CVCC. Fan coils used with the CVCC may be multi-speed or variable speed. The fan coil units are generally controlled by an indoor thermostat based on sensible temperature but may also be controlled by control outputs of the CVCC control system.

In another exemplary embodiment/iteration, the controls can be tuned to have the compressor 1201 more quickly match the BTU load and target temperature by using, rather than a thermostatic approach tied to LWT or EWT set point error, a different means of setting compressor speed, or by further extension of the following explanation, setting the pump 1205 speed, can be used. For example, a system (including a compressor, condenser, evaporator, expansion device, etc.) could be tested to produce a performance curve and coefficient for varying ambient and EWT conditions and target LWT, etc. As an example, based on testing at each ambient temperature and loop temperature and flow rate within the operating range, a table, curve or coefficient based on the relationship of these variables can created and be used as a lookup table or curve or coefficient or combination of these such that system parameters may be automatically set to match previously measured performance across the compressor frequency range to produce a required compressor frequency or speed that can be sent to controller 1204 or to the compressor control 801 to meet a certain capacity requirement. A LWT sensor and error correction routine may be used to monitor the LWT for accuracy, providing an override signal to compressor control board as needed. The same control logic using lookup tables as primary and with or without a feedback control secondary control logic can be applied to pump 1205 speed control.

In an exemplary embodiment/iteration, the system controller may see a return water temperature of 54° F., a leaving temperature of 44° F., the pump 1205 producing a ΔT of 10, and a flow rate of 2.4 GPM—at this point the system knows the current load on the system is ~12000 BTU as shown below:

BTU load=8.33×1.0×10×2.4×60=11,999 BTU

When the load changes, for example, return water temperature is seen to change from 54 to 56. The system would immediately know the following: the cooling load has increased BTU load=8.33×1.0×12° F.×2.4×60=12,000 BTU=14,394

Therefore based on this, the system would adjust the compressor speed to match the new BTU requirement and then adjust the pump speed so as to return the ΔT back to 10° F. (setting pump to a speed needed to produce a ΔT of 10° F.). This capacity matching approach can also be used in heating mode where the error from set point would be below, rather than above, the fluid temperature and heating capacity could be managed in the same manner as cooling.

In another example, the controller may decide, based on changes to one or more of the sensible temperature, relative humidity, enthalpy, condensation point, sensed from the conditioned space by controller 110 using a sensor such as sensor 1301, to change the leaving water temperature to a higher or lower temperature, for example, from 44° F. to 40° F., in this case the controller would see:

Current Conditions:

BTU load=8.33×1.0×10×2.4×60=12,000 BTU and know that to lower the leaving water temperature a further 4° F., compressor speed would be adjusted upwards to increase the compressor BTU capacity by an additional amount as indicated by a chart or curve or from set point, for example by an LWT sensor 920 such that the LWT reaches the 40° F. target, and the pump speed (GPM) would then be adjusted to reestablish the ΔT 10° F., continuing to match the rate of 2.4 GPM per each 12000 BTU. The 10ΔT is arbitrary and can be changed if or as needed to match other requirements, a ΔT of 10° F. is used as an example only.

Likewise, the controller can see a decrease in cooling load and adjust to it in real time. For example, a system running as BTU load=8.33×1.0×10×2.4×60=~12,000 BTU could see in 5° F. decrease in return water temperature indicating a reduction of cooling load. As an example:

BTU load=8.33×1.0×5×2.4×60=6,000 BTU

In this case the controls could respond to the new load conditions by (using tables or curve for the current conditions or thermostatic compressor control) changing the compressor 1201 speed to a frequency to match 6000 BTU and as the changes take effect on the system, the pump speed would be reduced to 1.2 GPM resulting in the GPM of 2.4 GPM per ton:

BTU load=8.33×1.0×10×1.2×60=6,000 BTU

In certain exemplary embodiments/iterations, the dynamic nature of the LWT setting controls can be harnessed for radiant cooling by controller 110. Radiant cooling is a cooling application where the user does not want the radiant panel to operate at a temperature below the condensation point so as to avoid condensation being produced. Controller 110, based on indoor measurements of humidity and temperature from sensor 1301 whereby the condensation point can be calculated, the LWT can be adjusted to target a temperature just above the condensation point to prevent unwanted condensation occurring on a radiant heat exchanger. As indoor humidity changes so does the condensation point, as changes occur controller 110 can respond by signaling the system to produce a loop temperature or LWT close to but not below the condensation point, resulting in maximum the maximum cooling effect possible without producing unwanted condensation.

In various exemplary embodiments/iterations, various indoor sensors can be used to measure or derive the needed information by the controller. For example, sensor 1301 could consist of a hygrometer or absolute humidity sensor combined with a sensible temperature sensor, from this sensor output all other psychrometric values such as relative humidity, enthalpy, wet bulb, etc. can be calculated and used as needed. Likewise, a wet bulb sensor and sensible temperature sensor inputs can be combined and used as sensor 1301 to derive the enthalpy, relative humidity, wet bulb, etc. The type or combination of sensors used is not relevant, provided that they can be used to measure the psychrometric values needed for the purpose.

In other exemplary embodiments/iterations, the controller 110 may have the ability to log, send, upload, or stream or broadcast settings, parameters, such live or historical data being sent to an outside receiving or display device for display, storage, or further processing. The controller 110 may be equipped with various alarm and notification outputs by GSM, SMTP, SMS or other protocols, Modbus or BacNet interfaces, and further have management capability over manual or automatic changeover from heating to cooling, dead band standby control, heating and cooling LWT/EWT reset, backup heat source control, tandem and lead-lag control, connection to and management of fan coil or AHU units fan speed, valve position, radiant or floor heating controls, single speed or variable speed booster pump control, external valve control, control over free cooling unit fans, pumps, valves, connection to outdoor temperature sensors, motion sensors, weather data inputs from external sources, as well as any other functions necessary to the control of a chiller 100 or hydronic heat pump operations.

Heating Control

As stated before, the same capacity control approaches that apply to cooling also apply to heating. However, with heating, a second heat source shown in FIGS. 15, 16 can be activated as backup heat at times when the CVCC capacity cannot match the heating load and in this case backup heat controller 1501 operates to control switch 1602 to drive variable power to resistance heating device 1601.

When the chiller 100 is in heating mode and running at maximum capacity, a shortfall of capacity is detected by controller 1204 when the system cannot maintain the target LWT/EWT temperature or required EWT/LWT ΔT for some period of X minutes of time. In this case, a BTU shortfall is determined and the CVCC responds by providing a signal to engage a resistance heating device 1601 applied to the loop at a point after the fluid leaves the chiller 100 to further raise the temperature to match the desired EWT target. The resistance heating device may be a water heating element inside a tank or pipe along the loop pathway, or may be constructed in some other way such that fluid flowing across or through the resistance heating section of the backup heat device 1601 receives heat energy from the backup heat device 1601.

In one non-limiting example, the CVCC has the ability to match the backup heat power level to the amount of BTUs of backup heat that is needed, such control capability may reside in either controller 1500 or in controller 1204.

For example of operation, in heating mode when at maximum heating capacity, if the target LWT is 100° F. (EWT+10° F.) and the actual LWT is 95° F. the CVCC controls can calculate the BTU of the shortfall by using information from the LWT temperature sensor and a flow meter 1010. For example if flow rate is at 5 GPM and the LWT shortfall is 5° F. below target, the controller 1501 knows the needed BTU (or W) of backup heat energy based on the following example calculation:

Shortfall amount in ° F.×flow rate in GPM×8.33×60×1.0/3.412=the amount of W that needs to be added to the loop to cause the temperature of the loop to rise to match the LWT target. In the 5 GPM example, BTU shortfall of 5° F. may calculated like this:

$$5^\circ\ F.\times 5\times 8.33\times 60\times 1.0=12495\ BTU/3.412=3662W$$

In this example, the CVCC control system would output a control signal to relay 1602 to engage and/or modulate the power of a resistance heating element to produce 3662 W of heating in order to match the BTU shortfall. Matching, without exceeding, the shortfall is important for both higher efficiency as well as operation of the chiller 100, since adding more heat than is needed could raise the EWT such that the system would interpret a drop in heating load and slow the compressor, etc. resulting in recursive error—slowing the BTU output of the compressor which would further increase the "need" for backup heat. Programming may be included such that compressor 1204 must run at a certain minimum speed while controller 1501 is called for backup heat.

It should be noted that the COP of resistance heat is 1.0 whereas the COP of the chiller 100 can be as high as 2, 3, or higher. Using the maximum amount of compressor provided heat and the minimum amount of resistance provided backup heat therefore improves overall COP of the system.

These calculations may occur continuously and the power variation to device 1601 may also be continuous as the heating load changes. The output of backup heat control 1501 to switch 1602 may be proportional, PWM, 0-10 v, controlled by current, or by some other signaling means that will control switch 1602 which may consist of a solid state relay such as an SSR, SCR or PWM switch or similar device so as to modulate the power of the resistance element, said modulation of power may be done via phase angle control, PWM, on-off switching, etc. or other means that controls the variable output of a resistance heater.

In other embodiments, the backup heat device control may be configured to "stand alone" using a thermostatic controller with feedback, sensors measuring one or more of the backup device entering or leaving fluid temperature, and/or flow sensor so that the backup device can modulate itself based on one or more of its exiting fluid temperature, its entering fluid temperature and flow rate, etc., to meet a BTU or final outlet temperature target, and then report back to the CVCC the watts or BTU of applied backup heating energy to so that the CVCC will know in real time how much backup heat has been applied and can allow for it accordingly to prevent compressor cycling.

In other non-limiting exemplary embodiments, the backup heat device 1601 and control can be used to calibrate itself or other components of the CVCC. For example, by comparing the entering and leaving temperature sensors when no heat is applied, the sensor outputs should match exactly, therefore a temperature sensor error can be quantified and an error correction offset obtained and used by the controller 1501 or by other controllers within the CVCC. Further, when the glycol percentage is known and when applying a steady and known W or BTU of heat, the temperature difference between the fluid entering and fluid leaving the backup heat section can be used to calculate the flow rate and compare it to the flow meter output for a calibration check. Because the formula of BTU=500×ΔT×GPM is reversible, any single unknown value can be calculated from the three known values and used to calibrate or confirm other input values and create a calibration offset. For example, if it is known that fluid entering the backup heat device 1601 is then leaving the backup heat device 1601 at an increased temperature of 5° F., and it is known that the W input is 3500 W, then it can be calculated that the flow rate is exactly 4.78 GPM, which could then be compared to the flow meter output to determine a flow meter output error and/or correction factor.

Although this backup heat device 1601 and controls can be part of the CVCC system, it would be clear to a person skilled in the art that this component and controls means could also be used in conjunction with many other hydronic heat pump systems.

In certain exemplary embodiments/iterations, the CVCC controller may also control indoor units as shown in FIG. 14. As mentioned previously, indoor equipment must be sized such that it can deliver the needed capacity at a wide range of variable loop temperatures. In an exemplary embodiment/iteration, the CVCC controller may control the fan speed or mode change based on sensor readings to compensate and adjust for varying loop temperatures when used in non-traditional ways such as a "vacation mode" whereby the system is controlled for humidity management without regards to temperature.

In certain exemplary embodiments/iterations, a "vacation mode" or "dry mode" may be offered. In this application, humidity would be prioritized over temperature, or used exclusively, as a means for setting the dynamic loop temperature. Further, fan coil, air handler or radiant panel controls may be controlled by the system based on input received by controller 110 or controller 1204 where such input is made by a manual input or received via wireless connection, computer network, by other devices such as phones, tablets, PCs, or internet connected devices through an internet connection.

It should also be appreciated that a more detailed explanation of the elements or components used in the present disclosure, instructions regarding how to use the specific and certain other items and/or techniques necessary for the implementation and/or operation of the various exemplary embodiments of the presently disclosed systems, methods, and/or apparatuses are not provided herein because such elements are commercially available and/or such background information will be known or become obvious during application, to one of ordinary skill in the art. Therefore, it is believed that the level of description provided herein is sufficient to enable one of ordinary skill in the art to understand and practice the systems, methods, and apparatuses, as described.

While the presently disclosed systems, methods, and/or apparatuses has been described in conjunction with the exemplary embodiments outlined above, the foregoing description of exemplary embodiments of the presently disclosed systems, methods, and/or apparatuses, as set forth above, are intended to be illustrative, not limiting and the fundamental disclosed systems, methods, and/or apparatuses should not be considered to be necessarily so constrained. It is evident that the presently disclosed systems, methods, and/or apparatuses is not limited to the particular variation (s) set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the presently disclosed systems, methods, and/or apparatuses, subject to any specifically excluded limit in the stated range. Where the stated range includes one or both of the limits, ranges excluding either or both of those included limits are also included in the presently disclosed systems, methods, and/or apparatuses.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the presently disclosed systems, methods, and/or apparatuses and elements or methods similar or equivalent to those described herein can be used in practicing the presently disclosed systems, methods, and/or apparatuses. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A hydronic heat pump system, comprising:

a heat pump having at least one controller and at least two heat exchangers, wherein at least one of said heat exchangers is a refrigerant-to-fluid heat exchanger, wherein at least one of said heat exchangers is serving a heating or cooling load, and wherein at least one of said heat exchangers is configured to absorb heat from or emit heat to an external environment;

a pump in addition to said heat pump;

a loop comprising piping and at least one heat exchanger in addition to said refrigerant-to-fluid heat exchanger, wherein said refrigerant-to-fluid heat exchanger and said pump are in fluid communication via at least a portion of said loop, wherein a heat transfer fluid is pumped via said pump, and wherein said heat transfer fluid leaves said refrigerant-to-fluid heat exchanger, via at least a portion of said loop, and returns back to said refrigerant-to-fluid heat exchanger, via at least a portion of said loop, at a higher or lower temperature;

a flow sensor sensing a flow rate of said heat transfer fluid;

at least one leaving water temperature sensor measuring a temperature of said heat transfer fluid on an outlet side of said refrigerant-to-fluid heat exchanger to determine a leaving fluid temperature; and at least one entering water temperature sensor measuring a temperature of said heat transfer fluid on an inlet side of said refrigerant-to-fluid heat exchanger to determine an entering fluid temperature, wherein a BTU load calculation is made by said at least one controller multiplying at least a flow rate by a calculated temperature difference between said determined leaving fluid temperature and said determined entering fluid temperature, and wherein a BTU capacity of said heat pump is controlled by said at least one controller adjusting at least a compressor speed to match a heating or cooling load based on a result of said BTU load calculation such that a heat pump capacity of said heat pump is targeted to match said BTU load calculation.

2. A hydronic heat pump system, comprising:

a heat pump having at least one controller and at least two heat exchangers, wherein at least one of said heat exchangers is a refrigerant-to-fluid heat exchanger, wherein at least one of said heat exchangers is serving a heating or cooling load, and wherein at least one of said heat exchangers is configured to absorb heat from or emit heat to an external environment;

a pump in addition to said heat pump;

a loop comprising piping and at least one heat exchanger in addition to said refrigerant-to-fluid heat exchanger, wherein said refrigerant-to-fluid heat exchanger and said pump are in fluid communication, with at least a portion of said loop, wherein a heat transfer fluid is pumped via said pump, and wherein said heat transfer fluid leaves said refrigerant-to-fluid heat exchanger, via at least a portion of said loop, and returns back to said refrigerant-to-fluid heat exchanger, via at least a portion of said loop, at a higher or lower temperature;

at least one flow sensor sensing a flow rate of said heat transfer fluid; and at least one temperature sensor measuring a temperature of said heat transfer fluid on at least one of an inlet side or an outlet side of said refrigerant-to-fluid heat exchanger to determine a temperature difference between said temperature sensor value and a temperature target of said heat transfer fluid, wherein a temperature difference between said temperature target and sensed temperature of said heat transfer fluid is calculated and such calculated value is multiplied by at least a flow rate to produce a BTU value representing a capacity shortage or overage required to match a current heating or cooling load, and wherein such BTU value is used to increase or decrease at least a speed of at least a compressor to adjust a heat pump BTU capacity such that an adjusted heat pump BTU capacity targets a resolution of any BTU differential between a heat pump capacity and a heating or cooling load.

3. A hydronic heat pump system, comprising:

a heat pump having at least one controller and at least two heat exchangers, wherein at least one of said heat exchangers is a refrigerant-to-fluid heat exchanger, wherein at least one of said heat exchangers is serving a heating or cooling load, and wherein at least one of said heat exchangers is configured to absorb heat from or emit heat to an external environment;

a pump in addition to said heat pump;

a loop comprising piping and at least one heat exchanger in addition to said refrigerant-to-fluid heat exchanger, wherein said refrigerant-to-fluid heat exchanger and said pump are in fluid communication via at least a portion of said loop, wherein a heat transfer fluid is pumped via said pump, and wherein said heat transfer fluid leaves said refrigerant-to-fluid heat exchanger, via at least a portion of said loop, and returns back to said refrigerant-to-fluid heat exchanger, via at least a portion of said loop, at a higher or lower temperature; and an indoor sensor configured to provide at least some humidity information to said at least one controller, and wherein, in a cooling mode, at least one of a leaving fluid temperature or an entering fluid temperature of said heat pump is modified by adjusting at least one of a compressor speed or a pump speed by said at least one controller in response to said humidity information from said indoor sensor, wherein said fluid temperature of said heat pump may be adjusted to increase a Carnot efficiency of said compressor if latent heat removal is not required by increasing said fluid temperature, and if said at least one controller determines that latent heat removal is required, said fluid temperature may be adjusted to a colder temperature, and wherein an adjustment to a colder temperature target may be calculated based on dew point information derived from said indoor sensor.

4. A hydronic heat pump system, comprising:

a heat pump having at least one controller and at least two heat exchangers, wherein at least one of said heat exchangers is a refrigerant-to-fluid heat exchanger, wherein at least one of said heat exchangers is serving a heating or cooling load, and wherein at least one of said heat exchangers is configured to absorb heat from or emit heat to an external environment;

a pump in addition to said heat pump;

a loop comprising piping and at least one heat exchanger in addition to said refrigerant-to-fluid heat exchanger, wherein said refrigerant-to-fluid heat exchanger and said pump are in fluid communication via at least a portion of said loop, wherein a heat transfer fluid is pumped via said pump, and wherein said heat transfer fluid leaves said refrigerant-to-fluid heat exchanger, via at least a portion of said loop, and returns back to said refrigerant-to-fluid heat exchanger, via at least a portion of said loop, at a higher or lower temperature;

at least one temperature sensor measuring a temperature of said heat transfer fluid on an inlet side or an outlet side of said refrigerant-to-fluid heat exchanger to determine a fluid temperature;

a flow sensor sensing a flow rate of said heat transfer fluid; and a variable power backup heat device, wherein in a heating mode, any shortfall of a heating capacity is detected and quantified by said at least one controller by comparing a BTU or wattage load to a BTU or wattage capacity, with a difference between said compared BTU or wattage load and said BTU or wattage capacity being said shortfall, based on temperature information from said at least one temperature sensor and a flow rate sensed by said flow sensor, and wherein said variable power backup heat device is controlled by adjusting its level of power to provide backup heat in a quantity equal to said BTU or wattage shortfall of said heating capacity.

* * * * *